US007913679B2

(12) United States Patent
Quinn et al.

(10) Patent No.: US 7,913,679 B2
(45) Date of Patent: Mar. 29, 2011

(54) VALVE ASSEMBLY FOR A COMPRESSED GAS GUN

(75) Inventors: Michael Quinn, East Hanover, NJ (US); Mel Maravilla, Jersey City, NJ (US); Kerry Johnson, Madison, NJ (US)

(73) Assignee: Kee Action Sports I LLC, Sewell, NJ (US)

( * ) Notice: Subject to any disclaimer, the term of this patent is extended or adjusted under 35 U.S.C. 154(b) by 955 days.

(21) Appl. No.: 11/150,002

(22) Filed: Jun. 10, 2005

(65) Prior Publication Data

US 2006/0005823 A1 Jan. 12, 2006

Related U.S. Application Data

(60) Provisional application No. 60/578,431, filed on Jun. 10, 2004.

(51) Int. Cl.
*F41B 11/00* (2006.01)

(52) U.S. Cl. ..... 124/77

(58) Field of Classification Search ..... 124/74, 124/77; 251/129.15

See application file for complete search history.

(56) References Cited

U.S. PATENT DOCUMENTS

| | | | |
|---|---|---|---|
| 495,767 | A | 4/1893 | Winans |
| 645,932 | A | 3/1900 | Beck et al. |
| 678,685 | A | 7/1901 | Rathbone |
| 1,191,877 | A | 7/1916 | Dickey |
| 1,441,975 | A | 1/1923 | Edelin |
| 1,503,913 | A | 8/1924 | Miles |
| 2,283,300 | A | 5/1942 | Vincent |
| 2,357,951 | A | 9/1944 | Hale |
| 2,550,887 | A | 5/1951 | Tratsch |
| 2,568,432 | A | 9/1951 | Cook |
| 2,594,240 | A | 4/1952 | Wells |
| 2,618,254 | A | 11/1952 | Wells |
| 2,634,717 | A | 4/1953 | Junkin |
| 2,881,752 | A | 4/1959 | Blahnik |
| 2,900,972 | A | 8/1959 | Marsh et al. |
| 3,000,371 | A | 9/1961 | Hyde |
| 3,170,487 | A | 2/1965 | Juilfs et al. |

(Continued)

FOREIGN PATENT DOCUMENTS

EP 0 467 089 B1 10/1995

(Continued)

OTHER PUBLICATIONS

Action Pursuit Games, Jan. 2001, pp. 86-92, Inside AirStar's Supernova ET, by James R. "Mad Dog" Morgan, Sr.

(Continued)

*Primary Examiner* — Troy Chambers
(74) *Attorney, Agent, or Firm* — Volpe and Koenig, P.C.

(57) ABSTRACT

A valve assembly according to the present invention includes a valve housing having a first end and a second end. A selectively closeable flow path runs through the valve housing. A valve body is disposed in the valve housing. The valve body is moveable from a first position closing the flow path to a second position opening the flow path. The valve body has a channel therethrough. A secondary chamber is provided adjacent the valve body in communication with the channel. An exhaust port is provided in communication with the secondary chamber. A solenoid is provided adjacent the secondary exhaust port, the solenoid adapted to selectively open the secondary exhaust port. A compressed gas gun employing the valve assembly is also provided.

22 Claims, 22 Drawing Sheets

U.S. PATENT DOCUMENTS 3,204,625 A 9/1965 Shepherd
3,465,742 A 9/1969 Herr
3,572,310 A 3/1971 Chiba
3,612,026 A 10/1971 Vadas
3,628,557 A 12/1971 Newborough
3,662,649 A 5/1972 Williams
3,693,654 A 9/1972 Runkle
3,741,189 A 6/1973 Kester et al.
3,773,025 A * 11/1973 Roeder et al. ..... 124/75
3,782,018 A 1/1974 Hancox
3,888,159 A 6/1975 Elmore et al.
3,913,620 A 10/1975 Pauliukonis
3,921,614 A 11/1975 Fogelgren
3,951,038 A 4/1976 Van Langenhoven
4,004,566 A 1/1977 Fischer
4,128,209 A 12/1978 Johnson
4,161,904 A 7/1979 Groen et al.
4,219,905 A 9/1980 Thacker et al.
4,275,758 A 6/1981 Masuda
4,280,248 A 7/1981 Herubel
4,304,213 A 12/1981 Jereckos
4,344,555 A 8/1982 Wolfberg
4,411,189 A 10/1983 Miller
4,446,599 A 5/1984 Karubian et al.
4,531,503 A 7/1985 Shepherd
4,544,034 A 10/1985 George
4,582,294 A * 4/1986 Fargo ..... 251/129.15
4,602,608 A 7/1986 Lacam et al.
4,616,622 A 10/1986 Milliman
4,770,153 A 9/1988 Edelman
4,819,610 A 4/1989 Lacam et al.
4,926,906 A 5/1990 Ichihashi et al.
4,936,282 A 6/1990 Dobbins et al.
5,062,454 A 11/1991 Ichihashi et al.
5,063,905 A 11/1991 Farrell
5,131,427 A 7/1992 Latza
5,257,614 A 11/1993 Sullivan
5,280,778 A 1/1994 Kotsiopoulos
5,333,594 A 8/1994 Robinson
5,337,655 A 8/1994 Bielfeldt
5,337,726 A 8/1994 Wood
5,339,791 A 8/1994 Sullivan
5,494,024 A 2/1996 Scott
5,503,137 A 4/1996 Fusco
5,515,838 A 5/1996 Anderson
5,572,982 A 11/1996 Williams
5,598,871 A 2/1997 Sturman et al.
5,613,483 A 3/1997 Lukas et al.
5,669,369 A 9/1997 Scott
5,704,342 A 1/1998 Gibson et al.
5,727,538 A 3/1998 Ellis
5,755,213 A 5/1998 Gardner et al.
5,769,066 A 6/1998 Schneider
5,771,621 A * 6/1998 Rogers ..... 42/55
5,878,736 A 3/1999 Lotuaco, III
5,913,303 A 6/1999 Kotsiopoulos
5,957,119 A 9/1999 Perry
6,003,504 A 12/1999 Rice et al.
6,003,547 A 12/1999 Tippmann, Jr.
6,024,077 A 2/2000 Kotsiopoulos
6,065,460 A 5/2000 Lotuaco, III
6,138,656 A 10/2000 Rice et al.
6,343,599 B1 2/2002 Perrone
6,349,711 B1 2/2002 Perry et al.
6,360,736 B1 3/2002 Juan
6,474,326 B1 11/2002 Smith et al.
6,520,171 B2 2/2003 Reible
6,532,949 B1 * 3/2003 McKendrick ..... 124/77
6,550,468 B1 4/2003 Tippmann, Jr.
6,557,542 B1 5/2003 Orr
6,561,176 B1 5/2003 Fujimoto et al.
6,601,780 B1 8/2003 Sheng
6,637,421 B2 10/2003 Smith et al.
6,644,295 B2 11/2003 Jones
6,658,982 B2 12/2003 Cherry
6,694,963 B1 2/2004 Taylor
6,708,685 B2 3/2004 Masse
6,763,822 B1 7/2004 Styles
6,807,959 B1 10/2004 Murdock et al.
6,810,871 B2 11/2004 Jones
6,832,605 B2 12/2004 Farrell
6,857,422 B2 2/2005 Pedicini et al.
6,860,259 B2 3/2005 Rice et al.
6,889,681 B1 5/2005 Alexander et al.
6,907,901 B2 6/2005 Holmes et al.
6,915,792 B1 7/2005 Sheng
6,925,997 B2 8/2005 Sheng
2001/0042543 A1 11/2001 Perrone
2002/0088449 A1 7/2002 Perrone
2002/0096164 A1 7/2002 Perrone
2002/0170551 A1 11/2002 Kotsiopoulos et al.
2003/0024520 A1 2/2003 Dobbins
2003/0024521 A1 2/2003 Smith et al.
2003/0047174 A1 3/2003 Tiberius et al.
2003/0047175 A1 3/2003 Farrell
2003/0079731 A1 5/2003 Dobbins
2003/0226555 A1 12/2003 Reible
2004/0065310 A1 4/2004 Masse
2004/0084040 A1 5/2004 Jones
2004/0134476 A1 7/2004 Smith et al.
2004/0144012 A1 7/2004 Adams
2004/0216728 A1 11/2004 Jong
2005/0115550 A1 6/2005 Jones
2005/0133014 A1 6/2005 Jones
2005/0155591 A1 7/2005 Forster
2005/0166747 A1 8/2005 Chenery et al.
2006/0011184 A1 1/2006 Jacobsson
2006/0011185 A1 1/2006 Jacobsson
2006/0011188 A1 1/2006 Jones
2006/0037597 A1 2/2006 Wood
2006/0225718 A1 10/2006 Kirwan
2007/0028909 A1 * 2/2007 Wood ..... 124/73
2007/0113836 A1 5/2007 Dobbins
2007/0209650 A1 9/2007 Jones
2007/0272222 A1 11/2007 Ho

FOREIGN PATENT DOCUMENTS

EP 1 197 723 A2 4/2002
EP 1 209 435 A2 5/2002
EP 1 209 435 A3 11/2002
EP 1 197 723 A3 3/2003
GB 2 193 797 A 2/1988
GB 2 228 067 A 8/1990
GB 2 258 913 A 2/1993
GB 2 313 655 12/1997
JP 61149676 A 7/1986
JP 3249485 A 11/1991
JP 2002317879 A 10/2002
SU 1384803 A1 3/1988

OTHER PUBLICATIONS

AirStar Nova 700 Exploded View Diagram.
Air Star Super Nova ET, by Bill Mills, WARPIG.com.
Air Star Nova FAQ, by Bill Mills, WARPIG.com.
Assault80 Limited Lifetime Warranty.
MAYHEM Owners Manual, Manufactured by Paintball Guns International.
Paintball 2-Xtremes Magazine, vol. 5, No. 9, Sep. 1999, AirStar's Super Nova E.T. Product Profile, pp. 30 and 94-95.
Paintball Magazine, Feb. 2000, E.T. Super Nova Staff Report, pp. 32-36.
SuperNova from AirStar Owners Manual.
War Machine, Inc., Tech Support, http://www.warmachinepaintball.com/techsupport.htm.
War Machine, Tech Support, Warranty and Operation of the Assault80.
War Machine Tech Support, Warranty and Operation of the Assault80.
ZDSPB.com, http://www.zdspb.com/tech/mayhem/disassembly.html, ZDS Paintball—Mayhem Disassembly Pictures.

* cited by examiner

VALVE ASSEMBLY FOR A COMPRESSED GAS GUN

CROSS REFERENCE TO RELATED APPLICATION(S)

This application claims the benefit of U.S. Provisional Application No. 60/578,431, filed Jun. 10, 2004, which is incorporated by reference as if fully set forth herein.

FIELD OF INVENTION

This invention relates to a valve assembly for a compressed gas gun, and a compressed gas gun incorporating the valve assembly.

BACKGROUND

Paintball is a sporting game having two teams of players usually trying to capture one another's flag. The sport is played on a large field with opposing home bases at each end. Each team's flag is located at the player's home base. In addition, all of the players have compressed gas guns, referred to herein as either "compressed gas guns" or "paintball markers", that shoot projectiles commonly referred to as paintballs. These paintballs are generally spherical gelatin capsules filled with paint. During play of the sport, the players on each team advance towards the opposing team's base in hopes of stealing the opposing team's flag, without being eliminated from the war game. A player is eliminated from the game when the player is hit by a paintball fired from an opposing player's marker. When the paintball hits a player, a "splat" of paint is left on the player.

Compressed gas guns (launching mechanisms) using compressed gas or air for firing projectiles are well known. As used herein, compressed gas gun refers to any gun or similar launching mechanism for use in sport wherein a projectile is fired via the force of compressed gas, and includes paintball markers. As used herein, projectiles refers to both paintballs, and other projectiles used in sport and game play.

Paintball markers have two basic mechanisms working in conjunction for firing a paintball from the marker during a firing operation. One of these mechanisms is for loading a paintball in the breech of a paintball marker, and usually involves a bolt that reciprocates from a loading position, allowing a projectile into the breech, to a firing position. A valving system is employed to release compressed gas from a source of compressed gas to fire the projectile from the marker.

Several types of compressed gas guns are available in the paintball sport field. These fall into two main classes or "actions": the "open bolt" action and the "closed bolt" action.

In the open bolt action, two chambers (upper and lower) are provided in a gun body. The upper chamber houses the bolt. The lower chamber houses a hammer and a valve, such as a pin type or poppet valve, also referred to as an exhaust or firing valve. The valve that controls the opening and closing of a flow passage between a high pressure chamber, and the upper chamber and bolt. The bolt moves during firing and returns to the loading (open) position after firing, in most cases by "blow back" gas pressure, thus the term "open bolt." A spring biases the bolt and/or hammer forward. The bolt and hammer are sometimes connected by a mechanical linkage, thus moving together. When the bolt is cocked in the loading position, the hammer is held in place such as by a sear. Releasing the sear by actuation (pulling) of the trigger allows the hammer and bolt to move forward by spring force. The bolt, in the firing position, is in alignment with the flow passage of the valve. In the firing position, the hammer impacts the valve, releasing high pressure compressed gas. The compressed gas flow through the flow passage, through the aperture in the bolt, and fires the chambered projectile.

In the closed bolt action, the bolt and hammer are arranged to move independently, thereby allowing for less "bounce" or "kick" when the gun is fired, since the bolt is not moving when the valve released compressed gas. The "closed bolt" action is referred to as such because the bolt is in the firing position, and paintballs are already chamber, prior to a mechanism such as a hammer opening the valve. In a closed bolt action paintball marker, a projectile is already chambered, and when the trigger is pulled, the hammer is released, striking the valve and sending gas through the bolt, thus firing a paintball.

A cross sectional side view of an illustrative prior art closed bolt mechanically cocking, or "automatically cocking," compressed gas gun 200 is shown in FIG. 19. A close bolt compressed gas gun 200 of the "automatically cocking" closed bolt action has a gun body 202, having an upper chamber or breech 204, and a lower chamber 206. The lower chamber 206 houses firing components, including a cocking rod 208 which projects rearwardly from the gun body, and has a hammer 210 at its forward end. The hammer 210 is biased forward by a cocking spring 212 in the rear of the lower chamber 206.

A firing valve 214 is provided in the lower chamber having a stem 216 facing the hammer 210, and a valve seat 218 on the opposite side of the firing valve 214. The firing valve 214 is normally of a spring-biased poppet valve, as is known in the art. A high pressure chamber 240 receives compressed gas under pressure from a compressed gas source (not shown) adjacent the seat 218. Generally, in the sport of paintball for example, the source of high pressure compressed gas is a compressed gas tank, as is well known in the art.

As shown in FIG. 19, the upper chamber 204 houses a bolt 220 having an aperture 222 therethrough. The bolt 220 is attached to a back block 224. Projectiles 226, such as paintballs, are received in the upper chamber 204 via an infeed opening 227.

A ram 228 is provided as a means for reciprocating the back block 224. The ram 228 performs as a pneumatically operated piston, and is connected to the back block 224 via a linking rod 230. A valve 232, generally of the "three-way" variety, positioned at a forward portion of the gun 200, is used to control the supply compressed gas to move the ram 228. In mechanically operating guns, a trigger 234 housed in a trigger frame 248 is mechanically linked to the valve 232. Actuating (pulling) the trigger 234 mechanically operates the three-way valve 232, allowing compressed gas to move the ram 228 which in turn moves the linking rod 230 and back block 224 rearward, placing the bolt in a loading position.

The cocking rod 208 is additionally moved rearward by the movement of the back block 224, which catches the rear end of the cocking rod 208 during the back block's rearward movement. By movement of the cocking rod 208, the hammer 210 is placed in a "cocked" position, with sear 236 holding hammer 210 in a cocked position. When the trigger is pulled and the sear 236 is released, it operates the three-way valve, which allows compressed gas to contact the rearward portion of the ram. The back block 224 moves forward, biasing the bolt 220 to a firing position. Pulling (actuating) the trigger moves the sear 236 away from the hammer 210, the hammer 210 is now released for forward motion, the spring 212 biases the hammer 210 forward to hit the valve stem 216. Upon contact by the hammer 210, the firing valve 214 opens to send compressed gas through the bolt 220, and the projectile 226 is fired. The bolt 220 will remain in the firing position (closed bolt) until the next firing operation is initiated by the trigger. A compressed gas gun 10 of the closed bolt "automatically cocking" closed bolt action type is described in detail in U.S. Pat. No. 6,763,822. While a mechanically operated paintball marker of the "automatically cocking" closed bolt type is shown, electronic closed bolt markers are available that operate with electronically operated trigger or valving systems.

As can be discerned from the above description, the mechanical back block, cocking rod and sear arrangement is not efficient, nor is the ram/three-way valve arrangement.

The consistency which compressed gas is released to fire a projectile greatly impacts the accuracy of a paintball marker. It would be advantageous to have a compressed gas gun where a novel valve mechanism is provided in place of the known assemblies discussed above.

SUMMARY

Briefly stated, the present invention is directed to a novel valve assembly for a compressed gas gun. The novel valve assembly can be utilized in either a closed bolt or an open bolt action compressed gas gun, although it is preferred that the novel valve assembly be incorporated into a closed bolt action compressed gas gun.

A valve assembly according to the present invention includes a valve housing having a first end and a second end. A selectively closeable flow path runs through the valve housing. A valve body is disposed in the valve housing. The valve body is moveable, by the force of compressed gas (pneumatically) and/or by a spring, from a first position closing the flow path to a second position opening the flow path. The valve body has a channel therethrough. A secondary chamber is located on a side of the valve body opposite the flow path in communication with the channel. An exhaust port is provided in communication with the secondary chamber. A selectively actuable solenoid is provided adjacent the secondary exhaust port, the solenoid is adapted to selectively open the secondary exhaust port.

A compressed gas gun utilizing the valve assembly of the present invention includes a compressed gas gun body having a breech, and a bolt moveable within the breech from a loading position to a firing position. The bolt has an aperture therethrough. A valve assembly is provided, including a valve housing having a first end and a second end. A selectively closeable flow path runs through the valve housing. A valve body is disposed in the valve housing. The valve body is pneumatically moveable from a first position closing the flow path to a second position opening the flow path. The valve body has a channel therethrough. A secondary chamber is provided located on a side of the valve body opposite the flow path in communication with the channel. An exhaust port is provided in communication with the secondary chamber. A solenoid is provided adjacent the secondary exhaust port, the solenoid adapted to selectively open the secondary exhaust port. The aperture of the bolt is positioned for fluid communication with the flow path when the bolt is in the firing position and the valve assembly is in the open position. A second valve assembly according to the present invention may be provided for controlling the pneumatic movement of the bolt.

The present invention is also directed to a method for converting a closed bolt action compressed gas gun with a valve assembly of the present invention.

The present invention eliminates the cocking rod and hammer arrangement, and may also eliminate the ram and/or the three-way valve, of known "automatically cocking" closed bolt compressed gas guns, and provides a simple, efficient pneumatic firing system that may be electronically controlled. An open bolt arrangement using the novel valve assembly of the present invention is also provided. In addition, the valve assembly of the present invention can be used to replace existing valves in compressed gas guns to increase performance.

BRIEF DESCRIPTION OF THE DRAWING(S)

Additional objects and advantages of the present invention will become apparent to those ordinarily skilled in the pertinent arts upon reading the following detailed description of a particularly preferred embodiment of the invention, which illustrates the best mode contemplated for practicing the invention, taken in conjunction with the accompanying drawings.

DETAILED DESCRIPTION OF THE PREFERRED EMBODIMENT(S)

Figure 1:
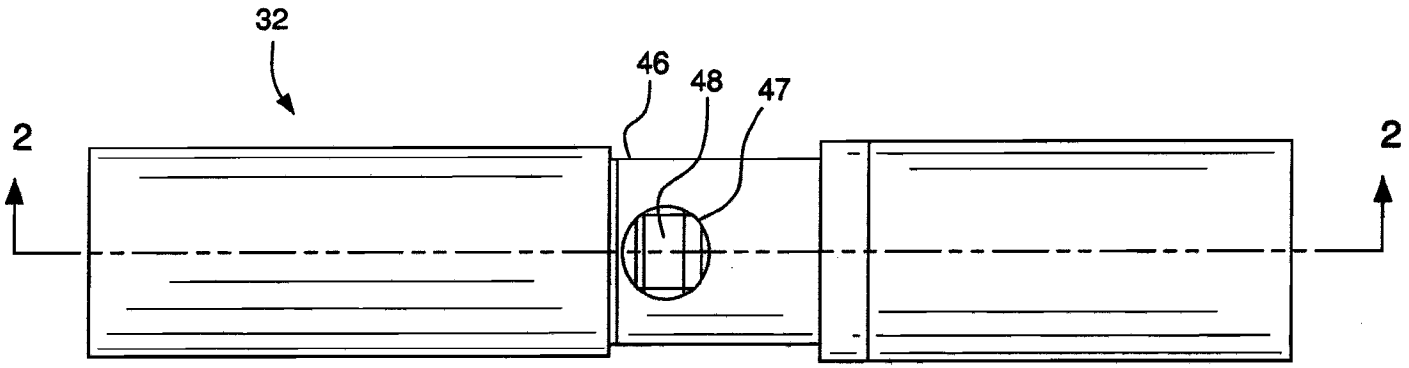
FIG. 1 shows a top plan view of a first embodiment of a valve assembly of the present invention.

Certain terminology is used in the following detailed description for convenience only and is not considered limiting. Several embodiments of a valve assembly of the present invention and a compressed gas gun incorporating the valve assembly is disclosed here and in the Figures. For clarity, within this document all reference to the top and bottom of the compressed gas gun and valve assembly will correspond to the compressed gas gun as oriented in FIGS. 4, 5, 11, and 13. Likewise, all reference to the front or forward portion of said compressed gas gun and valve assembly will correspond to the leftmost part of said gun as viewed in FIGS. 4, 5, 11, and 13, and all reference to the rear portion of said compressed gas gun and valve assembly will correspond to the rightmost part of said compressed gas gun and valve assembly as viewed in FIGS. 4, 5, 11, and 13. The words "upper" and "lower" designate directions in the drawings to which reference is made. The words "forward" and "rear" designate directions in the drawings to which reference is made. Additionally, the terms "a" and "one" are defined as including one or more of the referenced item unless specifically noted.

Figure 2:
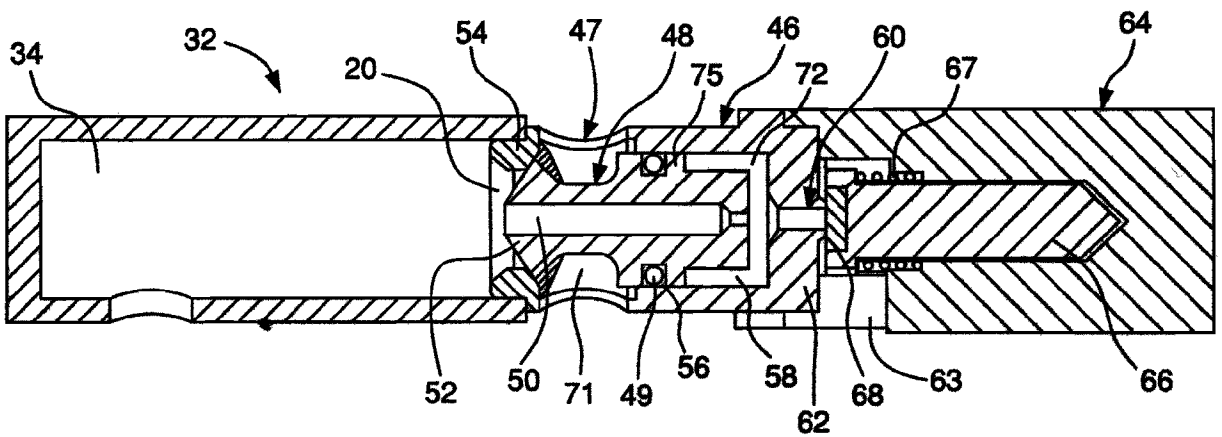
FIG. 2 shows a sectional view the valve assembly of the present invention shown in FIG. 1, taken along line 2-2, with the valve assembly in the closed position.
Figure 3:
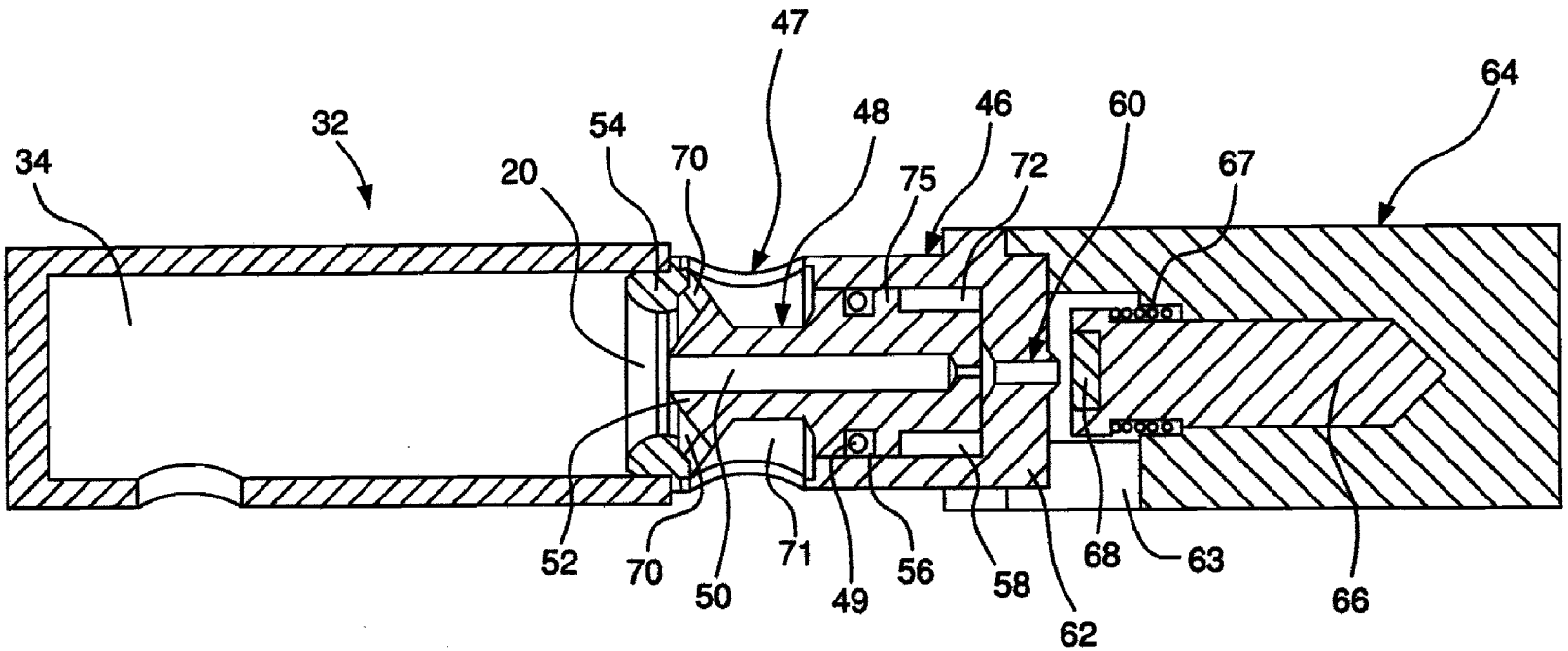
FIG. 3 shows a sectional view the valve assembly of the present invention shown in FIG. 2, with the valve assembly in the open position.

As shown in FIGS. 1-3, valve assembly 32 is provided, which may be sized to extend along the lower portion of a gun body 12, shown in FIG. 4, as will be further described below. The valve assembly 32 of the present invention may be used to replace "Nelson-style" or poppet valves normally used in "automatically cocking" type closed bolt paintball markers.

As shown in FIGS. 2 and 3, a high pressure chamber 34 is provided adjacent the valve assembly 32 and in communication with the valve assembly 32 via opening 20, which may be selectively closed off as will be described. It is expected that compressed gas at a high pressure will be supplied to the high pressure chamber 34 from a source of compressed gas (not shown), such as a compressed gas tank. The high pressure compressed gas will flow through opening 20 from the high pressure chamber 34 into a valve housing 46 of the valve assembly 32 via opening 20.

In one embodiment, of the valve assembly 32 a valve body 48 (which may be a spool or poppet valve or other acceptable valve body) is located within the valve housing 46. The valve housing 46 has a main valve port 47 provided as an opening in the valve housing 46 for communication of compressed gas from a compressed gas source. The main valve port 47 comprises part of the flow passage 70, described in greater detail below.

The valve body 48 is moveable from a ready-to-fire or first position, shown in FIG. 2, to a firing or second position as shown in FIG. 3. The valve body 48 has a channel 50 therethrough. The valve body 48 may be formed having a second portion 75 that is opposite to and larger than a first portion 52.

In a ready-to-fire or first position or closed position, the first or forward end or portion 52 of valve body 48 rests against seat 54 adjacent opening 20. In a firing position or second position or open position, valve body 48 is moved away from seat 54, as will be described in greater detail below. A flow passage 70 (also referred to as a "flow path", both "flow passage" and "flow path" being used interchangeably herein) is provided through the valve housing 46 and provides fluid communication between the high pressure chamber 34 and the aperture 30 of the bolt 18 of a compressed gas gun (shown in FIG. 4) when the valve body 48 is moved away from seat 54, thereby placing the valve assembly in an open position. An O-ring receiving space 56 may be provided along the valve body 48, for receiving an O-ring 49, as shown in FIGS. 2 and 3, to seal a secondary chamber 58 from the flow path 70.

A secondary chamber 58 is provided adjacent the second or rearward portion 62 of the valve body 48. The secondary chamber 58 is located within the valve housing 46 opposite opening 20. A secondary exhaust port 60 is provided as a channel running through the second portion 62 of the valve housing 46, which, when open, provides fluid communication between secondary chamber 58 and exhaust channel 63.

A solenoid 64 is provided adjacent the secondary exhaust port 60. The solenoid 64 includes a solenoid plunger 66, having a sealing portion 68. The solenoid 64 is electrically operable by actuation of the trigger 24, as will be described in greater detail below. The sealing portion 68 may be formed as a plug from an elastic material adapted for sealing air or gas channels, such as, for example, any rubber or silicone material. The solenoid plunger 66 is moveable, such that in a first or loading position shown in FIG. 2, the sealing portion 68 closes secondary exhaust port 60. The solenoid plunger 66 is biased to the first position by a solenoid spring 67. While the use of a "pull type" solenoid, biasing the solenoid plunger 66 against the bias of the solenoid spring 67 when the solenoid is actuated, is described, it is appreciated that other solenoid or valve arrangements could be used, as are known to those in the art.

The second portion 75 of the valve body 48 divides the valve housing 46 into a first pressure area 71 including the portions of the valve body 48 in contact with compressed gas forward of the second portion 75, and a second pressure area 72, including the portions of the valve body 48 in contact with compressed gas rearward of the second portion 75 when the solenoid 64 is not activated, and secondary exhaust port 60 is closed. It is appreciated that high pressure gas acts on both sides of the second portion 75. The movement of the valve body 48, is controlled, at least in part, by the different pressure forces acting on the valve body 48 from the first pressure area 71 and the second pressure area 72.

When the solenoid 64 is inactivate, the sealing portion 68 of the solenoid plunger 66 closes the secondary exhaust port 60, and compressed gas flows through the channel 50 in the valve body 48, from the high pressure chamber 34 to collect in the secondary chamber 58. When the secondary exhaust port 60 is closed, the effective surface area, or pressure area, in the second pressure area 72 is greater than effective surface area, or pressure area, in the high pressure chamber 34. The compressed gas accumulated in the second pressure area 72 exerts a pressure force on the valve body 48 that is greater than the opposing pressure force exerted by the compressed gas in the high pressure chamber 34, forcing the valve body to a first or closed position, with at least a portion of the first portion 52 of valve body 48 pressed against seat 54, as shown in FIG. 2.

It is appreciated that, rather than a channel 50 running through the valve body 48 to channel compressed gas from the high pressure chamber 34 to the secondary chamber 58, other channels in the gun body 12 or hoses or ports in the valve housing 46 could be employed to accomplish the same effect, so long as compressed gas is channeled to the secondary chamber 58.

When the sealing portion 68 of the solenoid plunger 66 is moved away from the secondary exhaust port 60, as shown in FIG. 3, opening secondary exhaust port 60, the compressed gas in the secondary chamber 58 is vented to exhaust channel 63, and may be vented to atmosphere from exhaust channel 63. Preferably, the solenoid plunger 66 is adapted to move quickly and return to its original position. With the decrease in pressure in the second pressure area 72, the pressure force in the high pressure chamber 34 forces the valve body 48 away from the seat 54, opening the valve assembly 32. Other assemblies for venting compressed gas from the secondary chamber 58 can be used, as are know in the art, including solenoid valves, mechanical valves, mechanical stoppers, pistons, flaps, and the like.

When the valve body 48 is in the second position, which is considered the "open" or firing position, flow passage 70 is opened, thereby allowing compressed gas from the high pressure chamber 34 to flow through flow passage 70. The compressed gas flowing through the flow passage 70 of the valve assembly 32 may, for example, be used to fire a projectile from the compressed gas gun, as will be described in greater detail below. The valve assembly of the present invention may also be used to control the movement of the bolt of a compressed gas gun, as shown in FIG. 4, and as will be described in greater detail below.

To close the valve body 48, the secondary chamber 58 is closed when the solenoid plunger 66 returns to an inactivated or ready-to-fire position, sealing secondary exhaust port 60. The secondary chamber 58 re-fills with compressed gas flowing thru the channel 50. The compressed gas pressure balance again shifts the valve assembly 32 to a closed position.

Figure 4:
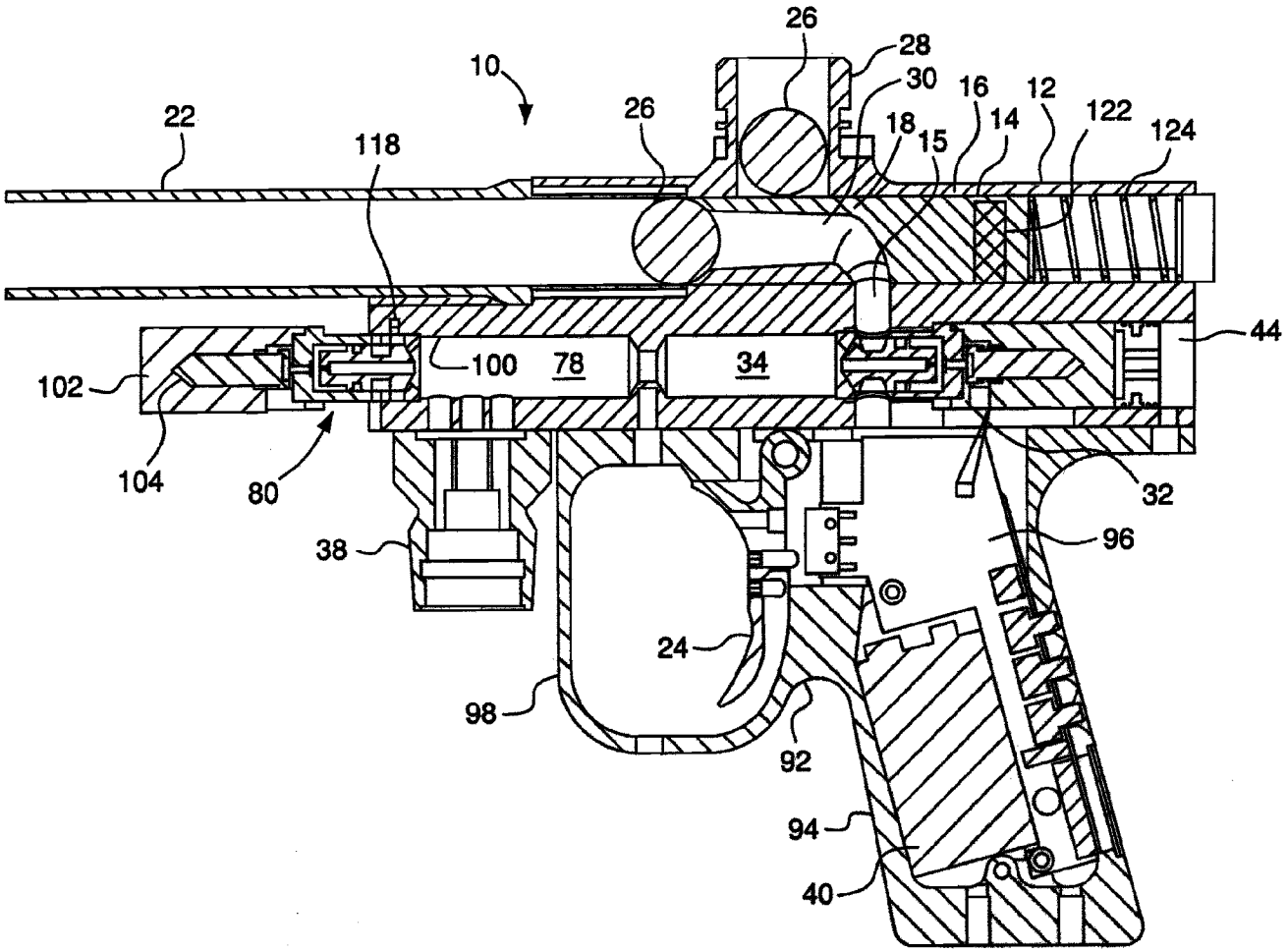
FIG. 4 shows a side sectional view of a compressed gas gun utilizing a firing valve assembly of the present invention and a forward valve assembly of the present invention, in a ready-to-fire position.
Figure 5:
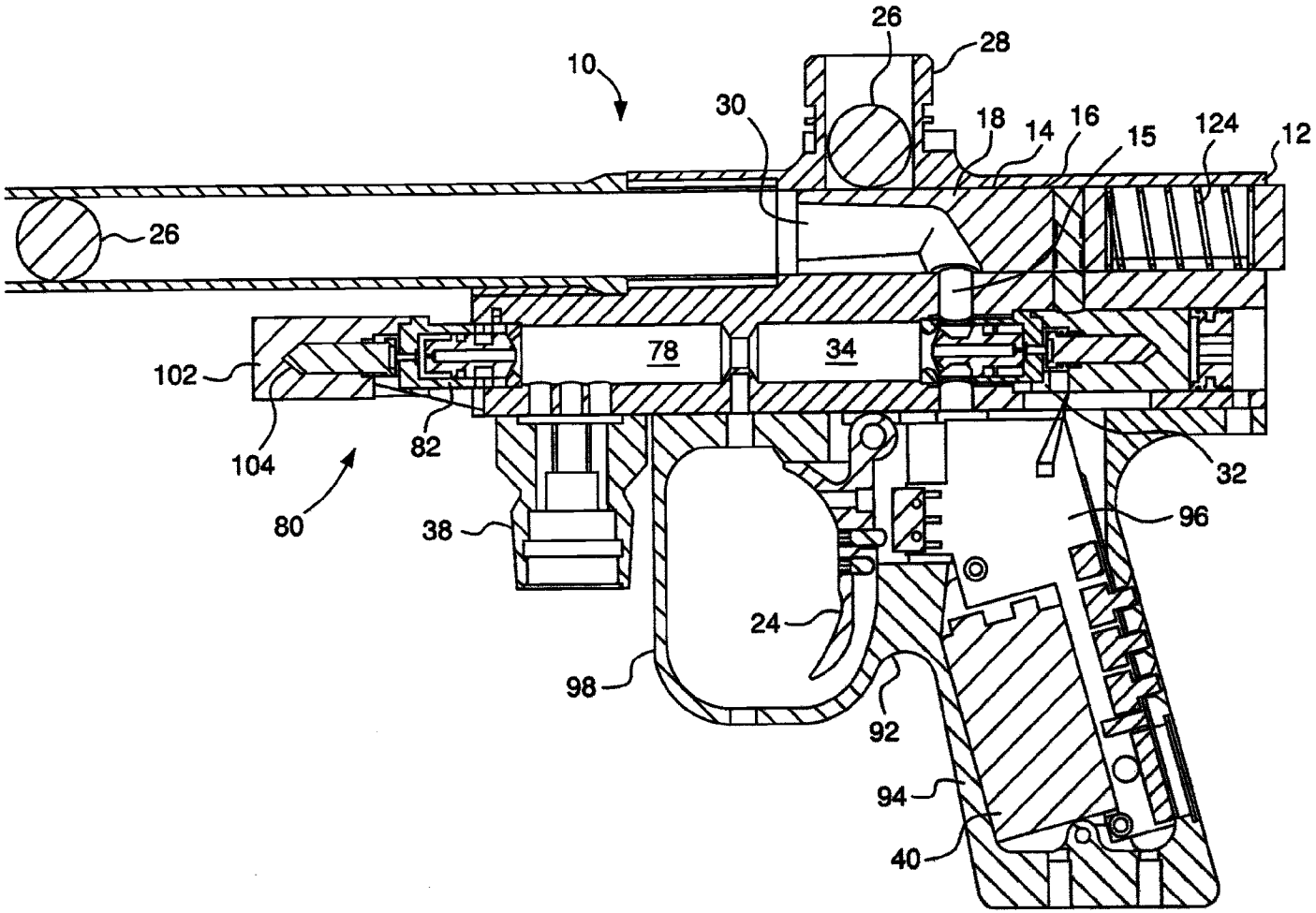
FIG. 5 shows a side sectional view of the compressed gas gun shown in FIG. 4, in a firing position.

Referring now to FIGS. 4-5, an embodiment of a compressed gas gun 10 having the valve assembly 32 of the present invention is shown. The compressed gas gun 10 shown in FIGS. 4-5 is of the closed bolt action type, similar to the type described above and described in detail in co-pending U.S. patent application Ser. No. 11/064,693, filed Feb. 23, 2005, the entire contents of which is incorporated by reference herein.

Figure 6:
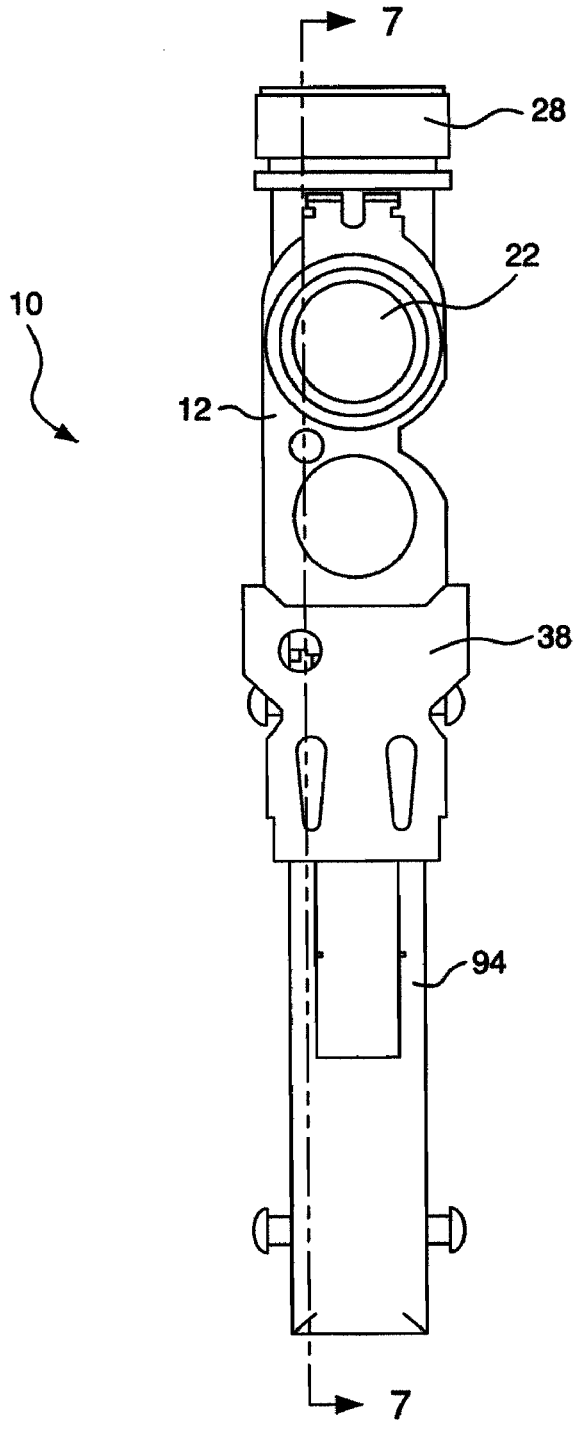
FIG. 6 shows a front plan view of the compressed gas gun shown in FIG. 4.

As shown in FIGS. 4-6, compressed gas gun 10 has a gun body 12, which has an upper chamber 14 and a lower chamber 44. The lower chamber 44 of the gun body 12 houses the valve assembly 32, previously described. A valve assembly 32 according to the present invention is positioned in the lower chamber 44. A pressure regulator adaptor 38 may be provided at a lower portion of the compressed gas gun body 12, in communication with the high pressure chamber 34. The pressure regulator adaptor 38 may be used to receive a regulator for adjustment of the operation of the compressed gas gun, as is known in the art. It is appreciated that a compressed gas gun utilizing the valve assembly of the present invention may not be equipped with a pressure regulator without departing from the present invention. In addition, an attached or "in-line" low pressure regulator may be used to adjust the compressed gas pressure from the compressed gas source.

The gun body 12, shown in FIGS. 4-6, has a breech 16 which chambers projectiles 26 for firing. A projectile infeed tube 28 is provided for receiving projectiles 26 into the breech 16. The infeed tube 28 may be attached to a projectile hopper or loader (not shown) mounted on top of the compressed gas gun 10. A barrel 22 may be permanently or removeably attached to the gun body 12, such as by threaded engagement. Gun body 12 may have a firing port 15 providing fluid communication with the main valve port 47 of the valve assembly 32, and adapted to supply compressed gas to the bolt aperture 30 of the bolt 18 when the bolt 18 is in the firing position.

A trigger frame 92 having a grip portion 94 may also be attached to the gun body 12. The trigger frame 92 includes a trigger guard 98 that protects the trigger 24, and may also house assemblies, a power source such as a battery 40, and electronic control circuitry 96 for operation of components of the compressed gas gun, described in greater detail below. The electronic control circuitry 96 may include a microprocessor for controlling a firing operation of the gun 10.

A bolt 18 is provided within the breech 16. The bolt 18 has a bolt aperture 30 therethrough, permitting the passage of compressed gas for firing a projectile. The bolt 18 is moveable from a first, forward, or firing position adjacent the forward end of the upper chamber 14 as shown in FIG. 4, to a second, rearward or loading position adjacent a rear of the upper chamber 14, as shown in FIG. 5.

A novel valve assembly and mechanism for operating the bolt of a compressed gas is also provided. In the example, the compressed gas gun is of the closed bolt type action. It is appreciated that in the closed bolt arrangement of the valve assembly 32 of the present invention, the bolt 18 moves completely independently of the valve assembly 32 (which can be considered the "firing" valve assembly for firing projectiles 26 from the gun 10), and the bolt movement is not dependent on operation of the valve assembly 32. In addition, the compressed gas flowing through the valve assembly 32 is not used to move the bolt 18, with the bolt 18 operated independently by a separate valve and or a combination of a separate valve and spring, as described in detail below.

Figure 4A:
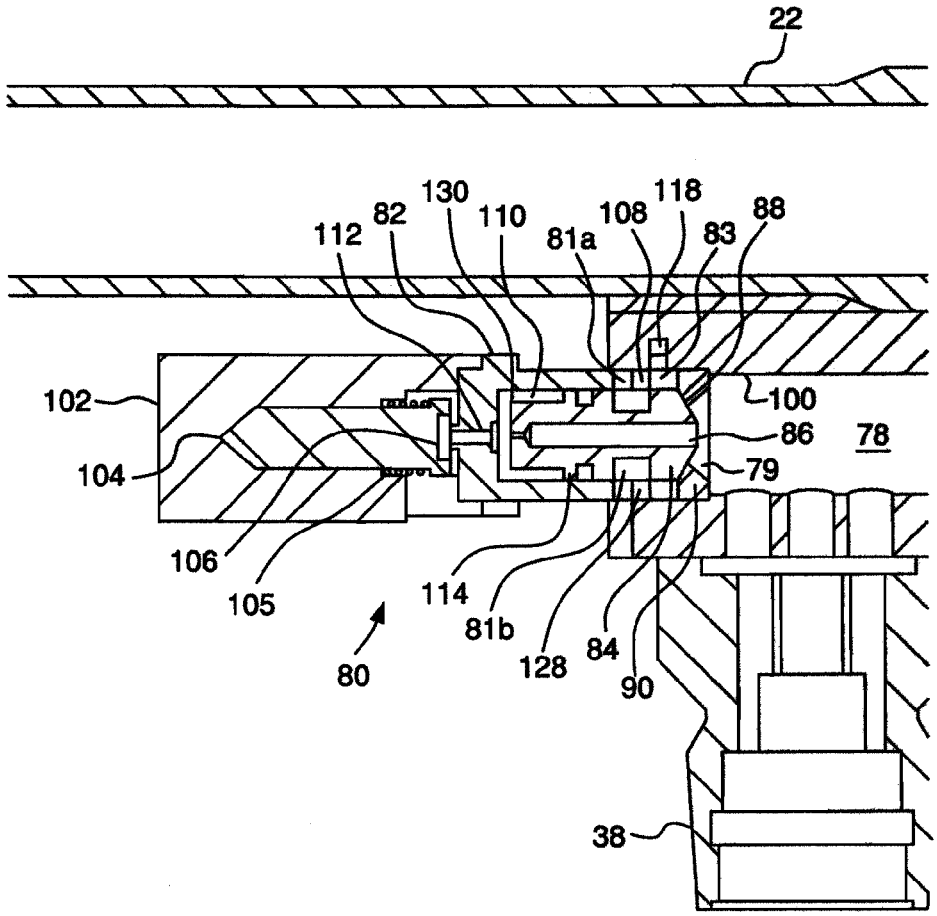
FIG. 4A shows a detailed close up view of the forward valve assembly shown in FIG. 4 in a ready-to-fire position.
Figure 5A:
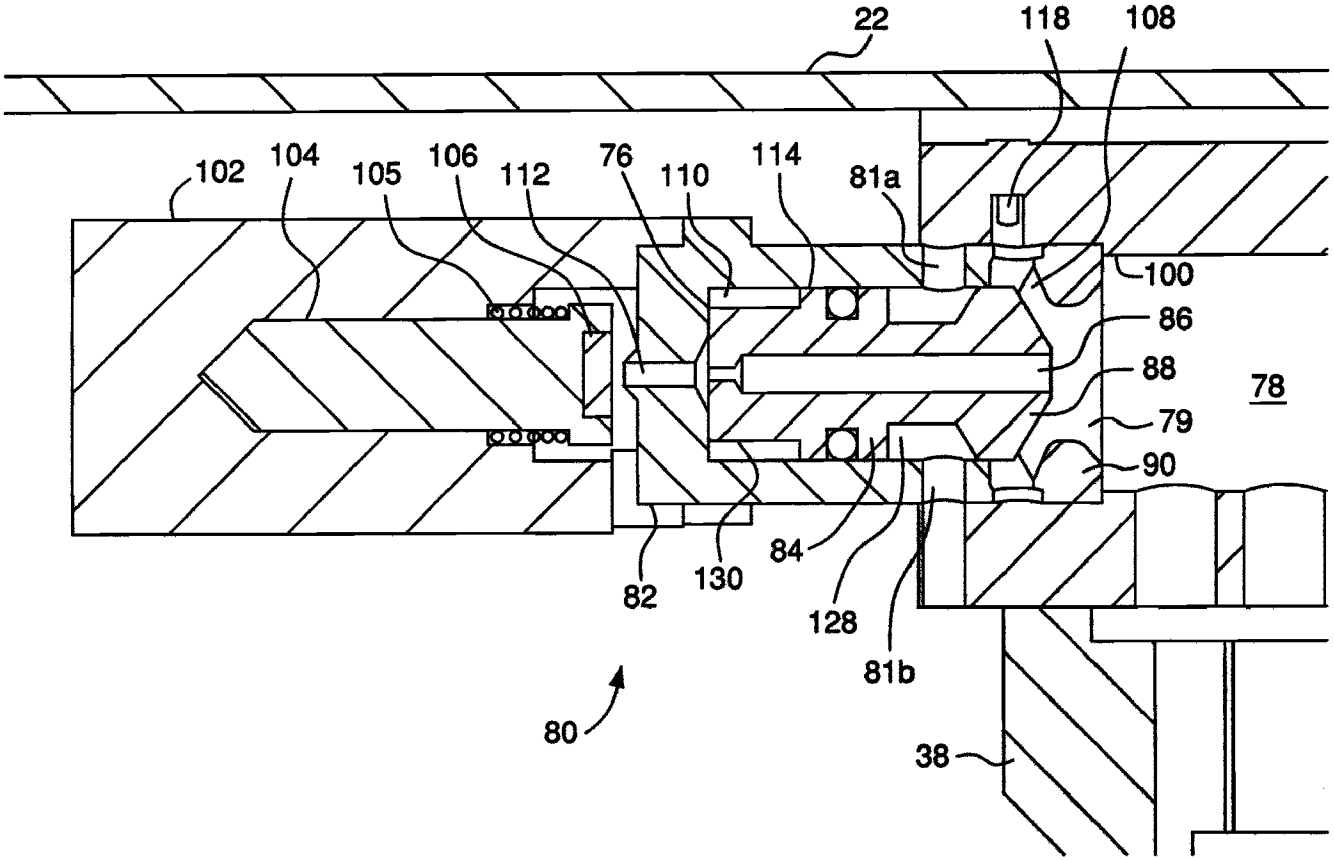
FIG. 5A shows a detailed close up view of the forward valve assembly shown in FIG. 5 in a firing position.

As shown in FIGS. 4-5A, high pressure chamber 34 has a first chamber 78 toward the front of the gun 10. A valve assembly 80 according to the present invention is provided at a forward end 100 of the first chamber 78. As previously described and shown in detail in FIG. 4*a*, valve assembly 80 has a valve housing 82, valve body 84, channel 86 through the valve body 84, and a seat 90. Valve housing 82 has a main valve port 83 that makes up at least part of a flow passage 108. Valve housing 82 may be in fluid communication with first chamber 78 via selectively closeable opening 79 in valve housing.

The valve body 84 has a first portion 88 and a rear portion 76 and a second portion 114. The second portion 114 of the valve body 84 has at least a portion that is preferably larger than first portion 88 and rear portion 76 of the valve body 84. The second portion 114 of the valve body 84 divides the valve assembly into a first pressure area 128 rearward, in FIG. 4A, of the valve body 84, and a second pressure area 130 forward of the valve body 84.

The valve housing 82 has a secondary chamber 110 at a second portion 114 of the valve housing 82. A secondary exhaust port 112 is provided. A solenoid 102 is provided, having a solenoid plunger 104 biased by a solenoid spring 105, with a sealing portion 106 adapted to close the secondary exhaust port 112. As can be seen from FIGS. 4 and 4*a*, the valve assembly 80 is in the reverse orientation of the valve assembly 32 previously described, with the solenoid 102 forward the valve housing 82. Ports 81(*a*) and 81(*b*) are provided in the valve housing 82 as drilled holes in the valve housing 82 communicating to atmosphere. When the valve assembly 80 is in the closed position with the valve body 84 resting against seat 90 sealing the valve housing, gas in the first pressure area 128 may vent to atmosphere through ports 81(*a*) and 81(*b*). When the valve assembly 80 is in the open position, ports 81(*a*) and 81(*b*) are closed off by the valve body 84 while the flow passage 108 is open.

It is appreciated that either valve assembly 32 or valve assembly 80 may be oriented in a different direction than pictured in the attached Figures and described herein, such as vertically oriented in relation to the longitudinal axis of the gun 10, with either the valve housing positioned top-most, or the solenoid positioned top-most. The orientation of either valve assembly 32 or valve assembly 80 may be changed according to the needs of a user, and is not limited to the orientations shown in the attached Figures.

The bolt 18 may be operated by the novel valve assembly 80 according to the present invention as follows. First chamber 78 receives compressed gas from a compressed gas source (not shown). When the solenoid 102 is not activated, sealing portion 106 of solenoid plunger 104 closes secondary exhaust port 112, and the valve assembly 80 operates as previously described. According to this embodiment, a bolt spring 124 is provided rearward of the bolt 18 in the upper chamber 14. Bolt spring 124 biases bolt 18 to the forward or firing position.

Figure 7:
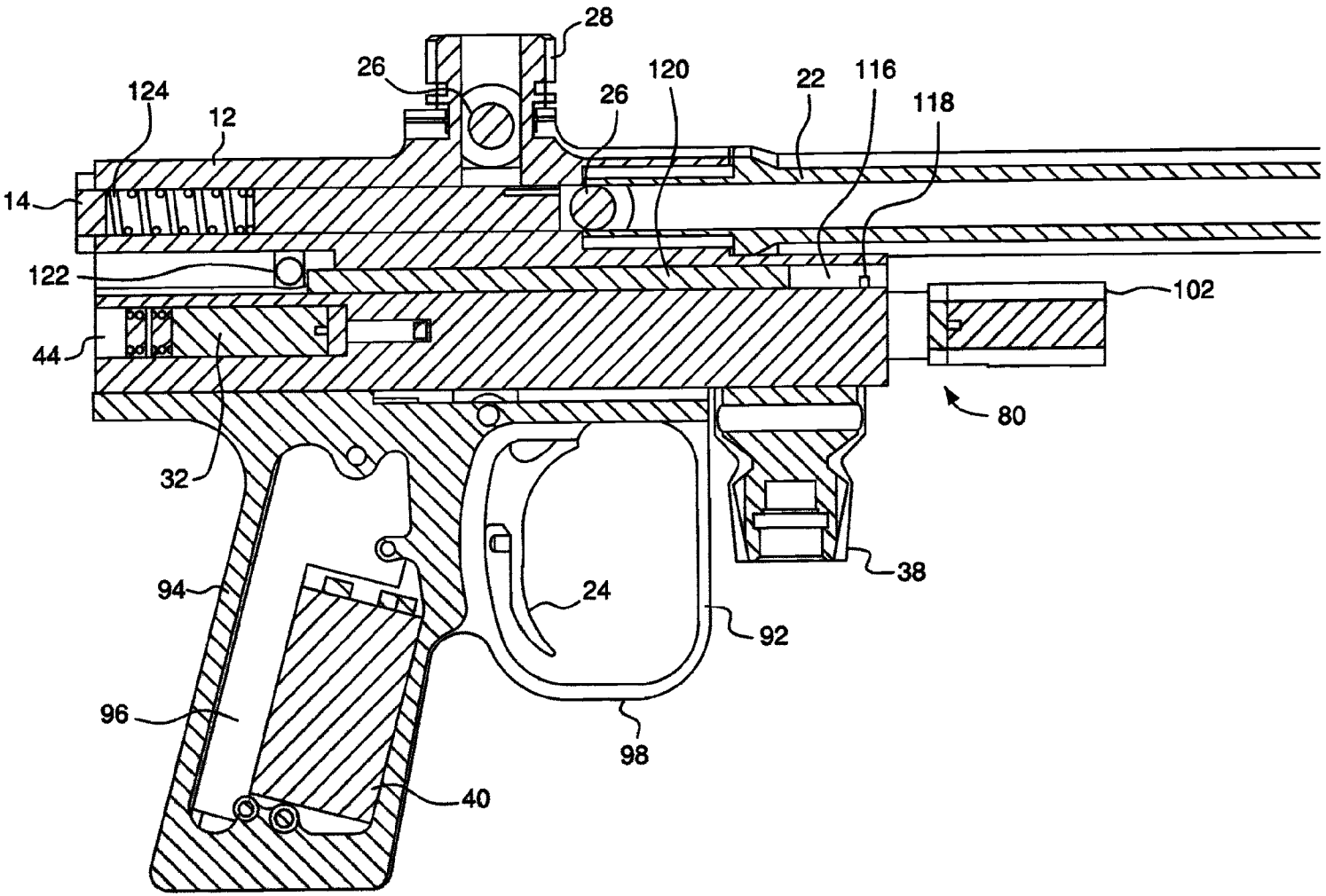
FIG. 7 shows a side sectional view taken along line 7-7 of FIG. 6, showing the bolt piston passage of the present invention.

According to this embodiment, a flow passage 108 is provided between the first chamber 78 and a bolt piston passage 116, as shown in FIG. 7. A port 118 may be provided running through the gun body 12, and providing fluid communication between the first chamber 78 and the bolt piston passage 116 when the valve assembly 80 is in the open position. The flow passage 108 is closed when the valve assembly 80 is in the closed position, and any gas in the bolt piston passage 116 may vent to atmosphere through ports 81(*a*) and 81(*b*).

As shown in FIG. 7, bolt piston passage 116 runs parallel to the longitudinal axis of the gun 10, and houses bolt piston 120. Bolt piston 120 is adapted to moved from a first or forward position to a second or rearward position within the bolt piston passage 116 by pneumatic force, against the bias of bolt spring 124. In its rearward position, bolt piston 120 contacts bolt pin 122, which may be an extension of the bolt 18 projecting into a bolt receiving pin channel 126 formed as the rearward portion of the bolt piston passage 116. The bolt pin 122 may be a link pin inserted into the bolt 18 and projecting into the bolt receiving pin channel 126. The bolt pin 122 may alternately be an extension of the bolt 18 projecting into a rearward potion of the bolt piston passage 116 adapted to receive the bolt pin 122.

When valve assembly 80 is opened by actuating solenoid 102, the flow passage 108 is opened, and bolt piston 120 moves rearwardly under pressure from compressed gas flowing through flow passage 108, until it contacts bolt pin 122. The compressed gas pressure flowing through flow passage 108 must be forceful enough to overcome bias of bolt spring 124. Further rearward movement of bolt piston 120 will move bolt pin 122 rearward, thereby "cocking" the gun 10 by moving the bolt 18 to a loading position. In the loading position, a projectile 26 can move from the infeed tube 28 to the breech 16.

Once the solenoid 102 ceases being actuated, valve assembly 80 closes, based on the pressure in the second chamber 110 increasing and moving the valve body 84 to a closed position against the seat 90, closing flow passage 108, and venting compressed gas from bolt piston passage 116 to atmosphere through ports 81(*a*) and 81(*b*). The compressed gas pressure in the bolt piston passage 116 is no longer sufficient to overcome the bias of bolt spring 124. Thus, bolt spring 124 moves bolt 18 to its forward or firing position. As bolt 18 moves forward, the bolt pin 122 contacts bolt piston 120, and bolt piston 120 is returned to the forward portion of the bolt piston passage 116.

During the firing operation of a closed bolt action design of a compressed gas gun using one or more valve assemblies according to the present invention, the electronic control circuitry 96 may be set to cycle the valve assemblies 32, 80 upon actuation (pulling) of the trigger, to provide for firing of the gun by first having the bolt cycle from a forward or firing position, to a rearward or loading position, and back to a firing position thereby chambering a projectile, and then having a valve assembly such as valve assembly 32 operate to provide high pressure compressed gas for firing a chambered projectile. Thus, where a forward valve assembly 80 is employed for moving the bolt 18, upon actuation of the trigger, the solenoid 102 will be actuated, and valve assembly 80 will open and close, thereby causing the bolt 18 to cycle from a loading position to a firing position to chamber a projectile. Then, the valve assembly 32 would be actuated for firing the projectile.

Once bolt 18 is in its firing position, the bolt aperture 30 is positioned adjacent firing port 15, and is therefore in fluid communication with the flow passage 70 of valve assembly 32, as shown in FIGS. 4-5. When valve assembly 32 is open, high pressure compressed gas escaping through flow passage 70 and firing port 15 will flow through bolt aperture 30, firing projectile 26 through the barrel 22, thus completing a firing operation.

Figure 8:
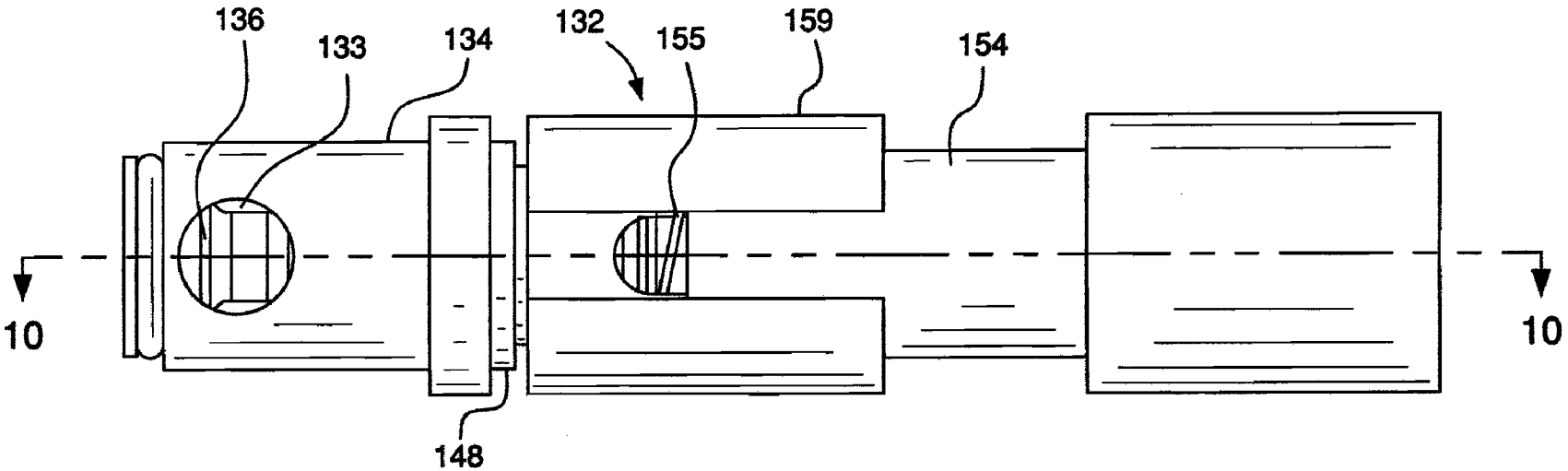
FIG. 8 shows a top plan view of an alternate embodiment of a valve assembly according to the present invention.
Figure 9:
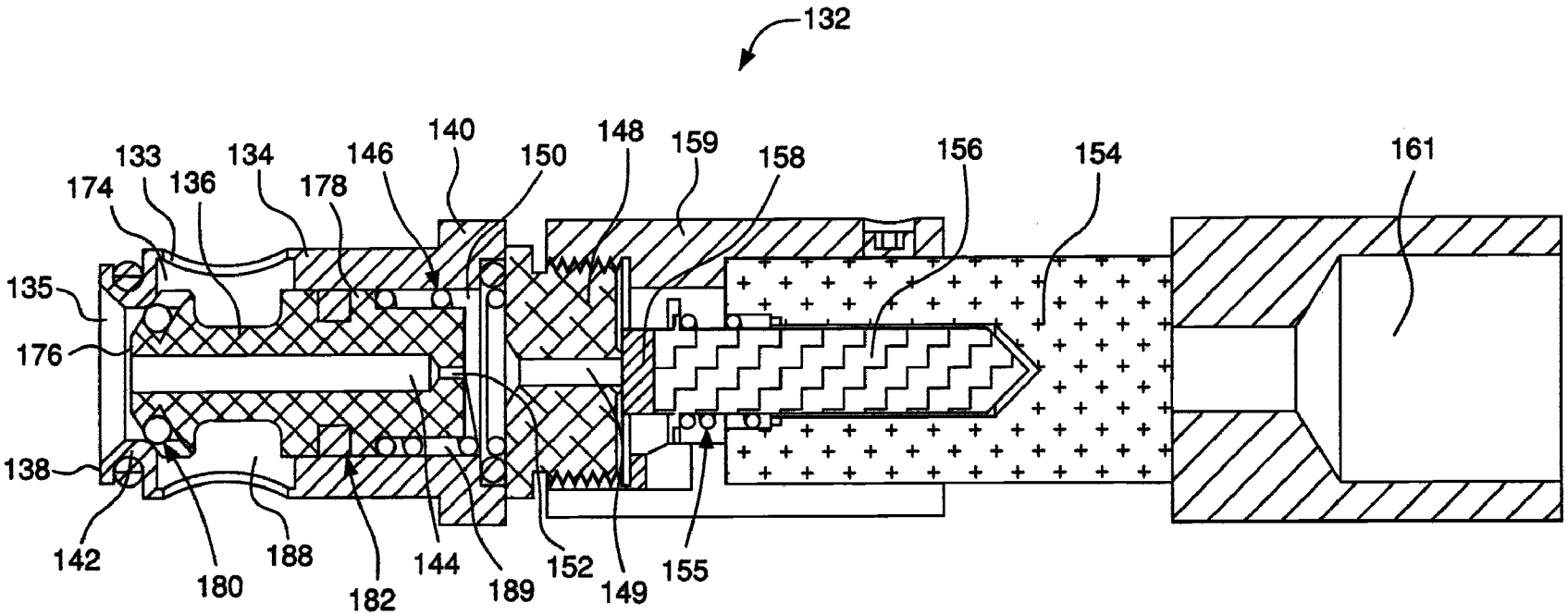
FIG. 9 shows a sectional view the valve assembly of the present invention shown in FIG. 8, taken along line 9-9, with the valve assembly in the closed position.
Figure 10:
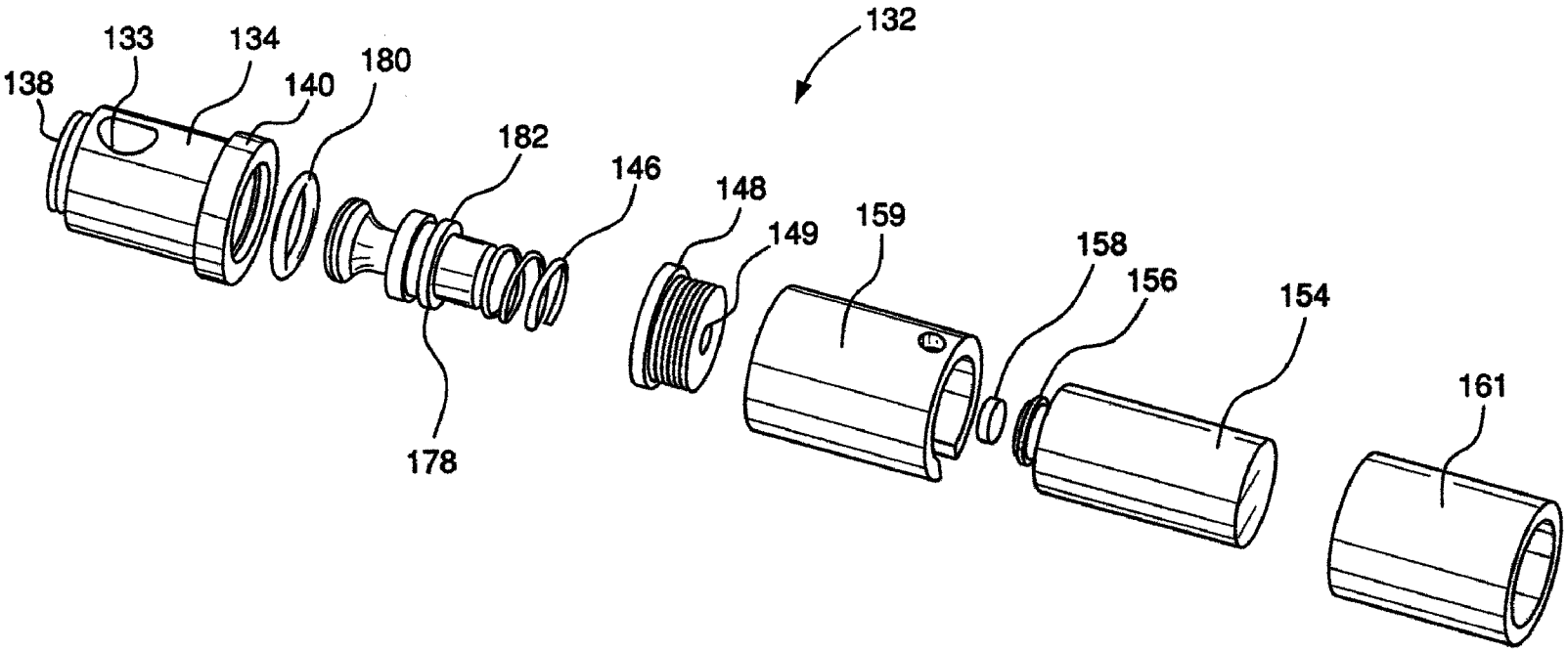
FIG. 10 shows an exploded isometric view of the valve assembly of FIG. 8.

An alternate embodiment of the valve assembly is shown in FIGS. 8-10. As shown in detail in FIGS. 10 and 11, valve assembly 132 has a valve housing 134 housing a valve body 136. Valve housing 134 has a main valve port 133 making up at least part of flow passage 174. Valve housing 134 has selectively closeable opening 135 for fluid communication with a high pressure chamber supplying compressed gas from a source of compressed gas.

The valve body 136 is moveable from a first, closed position as shown in FIG. 9, to a second, open position in which valve body 136 moves toward the second end 140 of the valve housing 134, opening the opening 135 and flow path 174. The first portion 176 of valve body 136 can be provided with an O-ring 180 to assist in closing flow passage 174. The second portion 178 of valve body 136 may be provided with an O-ring 182 or "quad ring" to assist in maintaining compressed gas within secondary chamber 150. The second portion 178 of valve body 136 is preferably sized to be larger than the first portion 176 of the valve body 136. The second portion 178 of valve body 136 divides the valve assembly 132 into a first pressure area 188 and a second pressure area 189.

A seat 142 is provided adjacent the first end 138 of the valve housing 134. An channel 144 runs through the valve body 136. A valve spring 146 is provided within the valve housing 134 adjacent the second end 140, assisting in biasing the valve body 136 toward the seat 142. An orifice plate 148 is provided adjacent the second end 140 of the valve housing 134 having an orifice channel 149, and enclosing a secondary chamber 150 adjacent the second end 140 of the valve housing 134. The orifice plate 148 has a secondary channel 152 therethrough. A solenoid 154 is provided having a solenoid plunger 156 and a sealing portion 158 is provided, for sealing the a secondary channel 152. A solenoid spacer 159 can be provided for threadably or otherwise securing the solenoid 154 to the orifice plate 148. A solenoid spring 155 biases the solenoid to a first position, sealing the a secondary channel 152. A set screw may be provided in a threaded opening the valve housing 134. A rod spacer 161 can be provided to fill the space in a gun body where a cocking rod and hammer of a prior art closed bolt compressed gas gun would be, when using valve assembly 132 as a replacement component.

Figure 11:
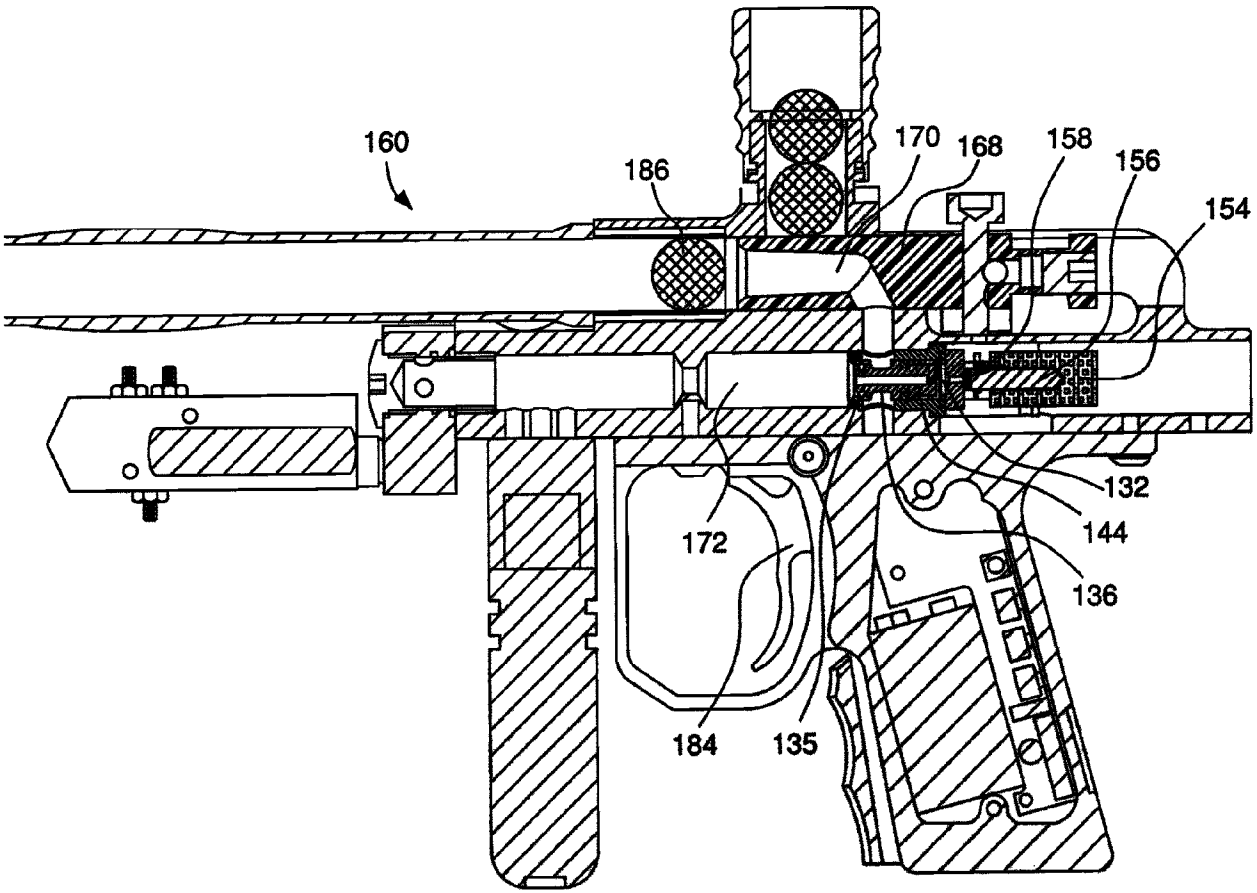
FIG. 11 shows a side sectional view of a compressed gas gun employing the valve assembly of FIG. 8.

This embodiment operates similar to the previously described embodiments, with the addition of a spring assist by spring 146 that works in conjunction with the effective surface area difference to return the valve body 136 to the closed position more quickly. A compressed gas gun 160 incorporating this embodiment is shown in FIG. 11. The compressed gas gun 160 has a gun body 162, with an upper chamber 164 and a lower chamber 166. The upper chamber 164 houses a bolt 168 moveable from a loading position to a firing position, having a bolt aperture 170 therethrough.

The valve assembly 132 is provided in lower chamber 166. A high pressure chamber 172 is provided adjacent valve assembly 132 for supplying compressed gas from a compressed gas source to the valve assembly 132 via opening 135. The gun 160 operates as previously described, with movement of the valve body 136 assisted by the valve spring 146. Prior to initiating a firing operation, the valve spring 146 biases valve assembly 132 to a closed position. In addition, the movement of the valve body 136 to a closed position is assisted by compressed gas flowing through channel 144 from the high pressure chamber 172 to the secondary chamber 150 and accumulating in the secondary chamber 150, as previously described. Due to the imbalance in pressure force on the valve body 136 caused by the difference in pressure on effective surface areas of first portion 176 if valve body 136 and first pressure area 188, in comparison to the second pressure area 189, the valve body 136 is forced against seat 142, and the valve assembly 132 is in a closed position.

Actuating (pulling) the trigger 184 sends an electrical signal to actuate the solenoid 154. Actuating the solenoid 154 moves solenoid plunger 156 away from secondary channel 152. Compressed gas from the secondary chamber 150 vents through secondary channel 152. The pressure imbalance forces valve body 136 toward the second end 140 of the valve housing 134, against bias of valve spring 146, opening flow passage 174. When the bolt 168 is in the firing position, with bolt aperture aligned with flow passage 174, compressed gas will flow through the valve housing 134 from the high pressure chamber 172 to the bolt aperture 170, firing a projectile 186 from the gun 160. The bolt 168 may be moved from a loading to a firing position as previously described, with a 3-way valve and ram arrangement as in the closed bolt "automatically cocking" style markers, or with compressed gas supplied to the forward end and rear end of the bolt.

When the solenoid 154 is not activated (electricity is no longer supplied), the solenoid plunger 156 will return to its original position, with the sealing portion 158 closing off the secondary channel 152. The valve assembly 132 will then close.

It is appreciated that the valve housing may house the solenoid, or the solenoid may be included as a separate assembly.

Unique features of the valve assembly of the present invention are apparent. The valve assembly of the present invention uses the high pressure gas from a high pressure chamber to provide the force that opens and closes the valve. This means that no secondary regulation is required. It also means the valve assembly provides a valve and compressed gas gun using the valve with minimal parts and porting.

By using the high pressure compressed gas in the high pressure chamber to move the valve, the valve assembly can be opened and closed quickly and with virtually no lag time. This make for efficient use of air.

The valve assembly of the present invention can have the air channels or ports that allow communication between the front and back of the valve or spool drilled straight through the valve itself, eliminating costly or large ports or air lines.

The seal on the front of the valve can be adapted to any pressure or assembly method, including a face seal, a tapered seal, or a radial seal.

The valve assembly can also be used to close off or open up other channels or ports used by compressed gas guns. This can turn a valve from a "2-way" valve into a "3-way" or multi-way valve.

The valve assembly can be sized to operate at any pressure and flow rate making suitable as the main firing valve of a compressed gas gun, or as a secondary valve that moves a "bolt" to chamber a projectile.

Since only a small volume of air needs to be vented in order to allow the valve body to move, a very small secondary valve such as a solenoid can be used to accomplish this.

It is contemplated that a compressed gas gun made according to the present invention may include a bolt that reciprocates by a ram, rod and back block arrangement, or may include a bolt that reciprocates by blow back gas, a spring arrangement, or by alternately directing compressed gas to the forward and rearward portions of the bolt. Any means for reciprocating the bolt may be used without departing from the present invention. In the closed bolt arrangement, the bolt movement should be independent from the movement of the pneumatic assembly, as discussed in greater detail below.

Figure 12:
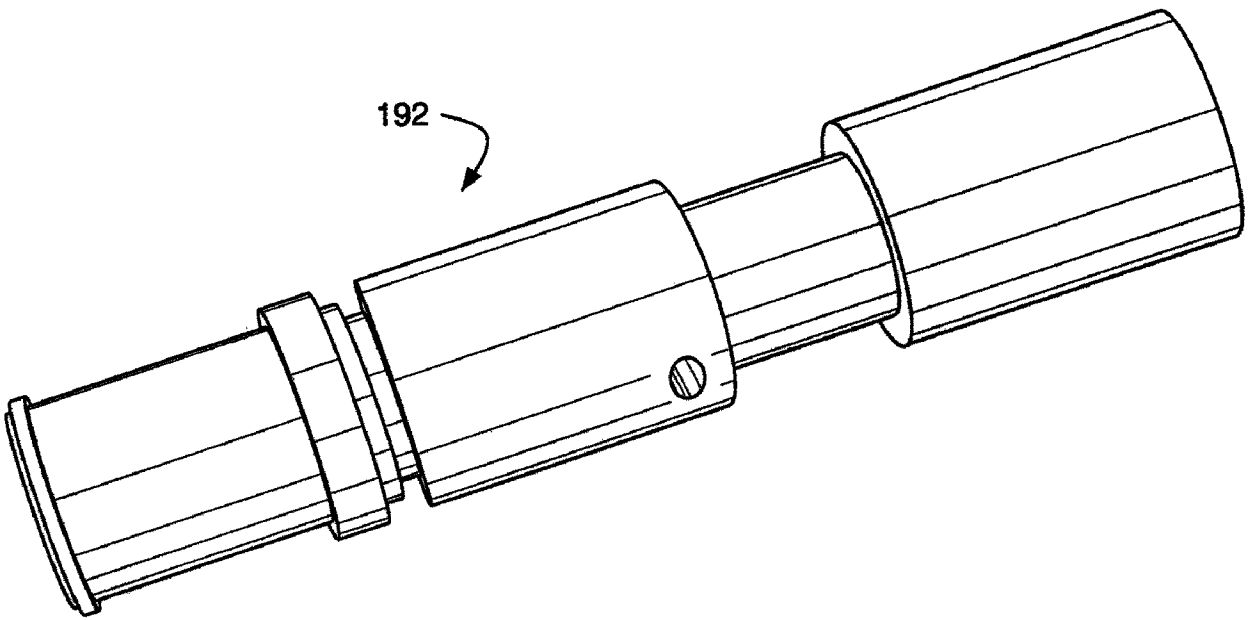
FIG. 12 shows a valve assembly replacement unit of the present invention.
Figure 13:
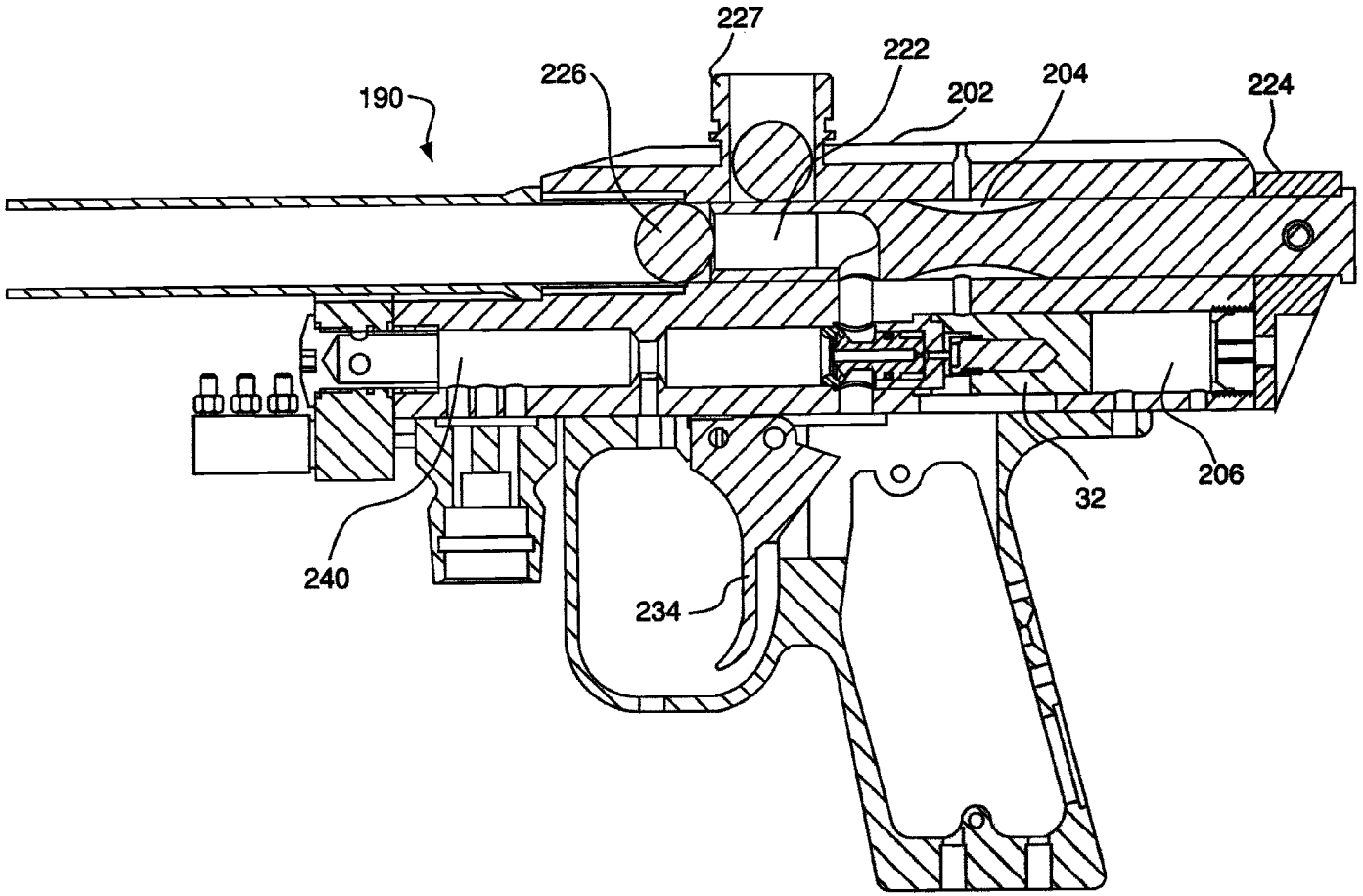
FIG. 13 shows a side sectional view of a closed bolt "automatically cocking" style compressed gas gun modified to incorporate a valve assembly of the present invention.
Figure 14:
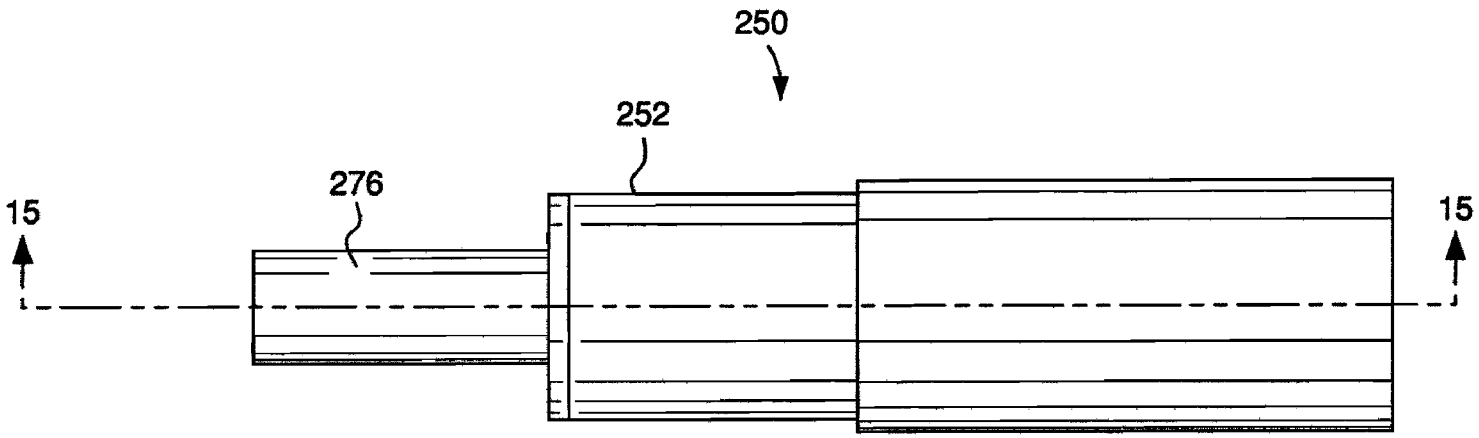
FIG. 14 shows a top plan view of a further embodiment of a valve assembly according to the present invention.
Figure 19:
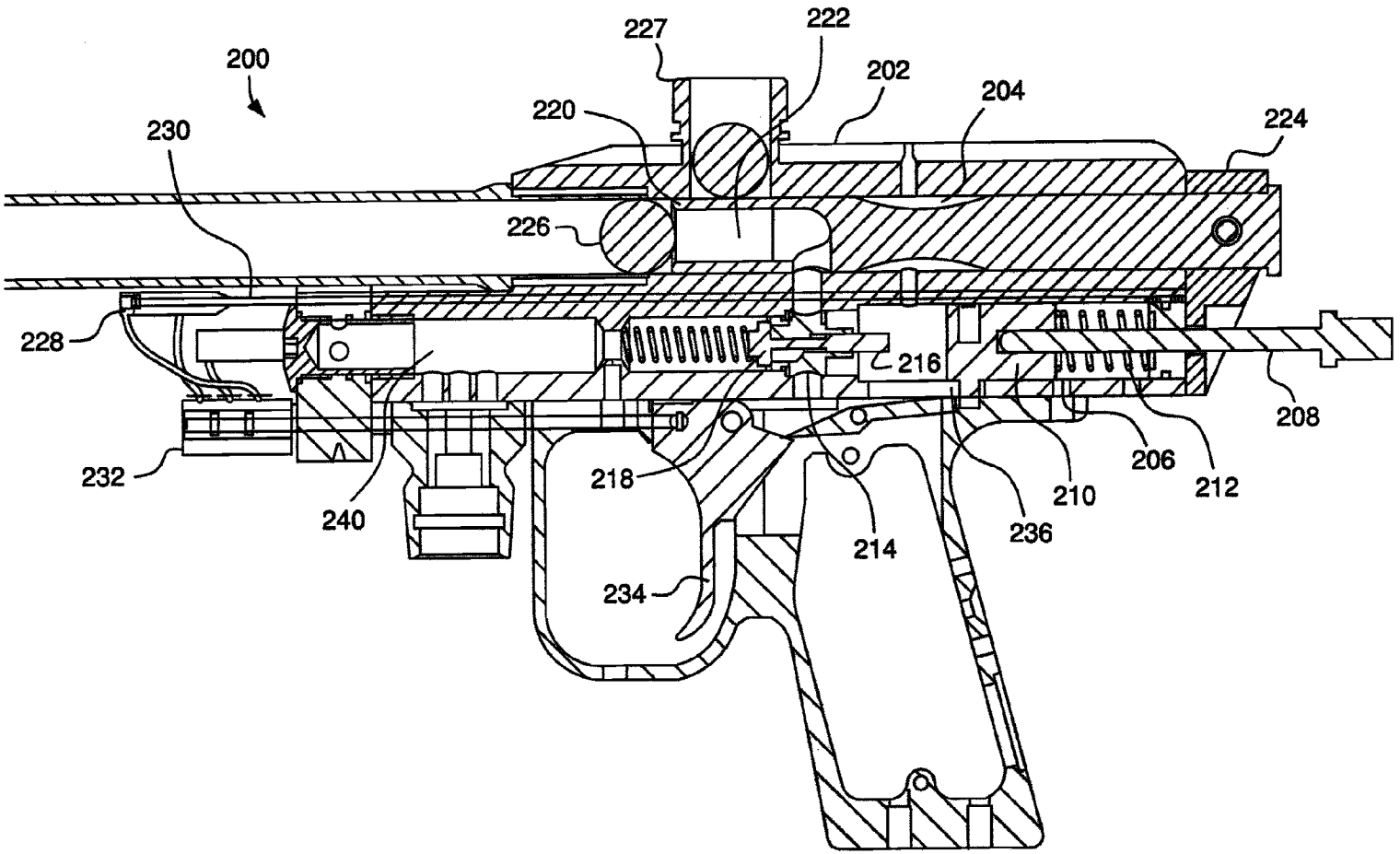
FIG. 19 (Prior Art)
FIG. 19 shows a prior art mechanical closed bolt style compressed gas gun.

The valve assembly of the present invention may also be used to convert an existing "automatically cocking" compressed gas gun to include the valve assembly disclosed herein. In that case, the original cocking rod, cocking spring, hammer and/or three-way valve may be replaced by one or more valve assemblies of the present invention. As shown in FIG. 13, a prior art closed bolt "automatically cocking"-style gun 190 has been modified, with a valve assembly 32 of the present invention replacing the hammer 210, cocking rod 208, and cocking spring 212 shown in FIG. 19. In addition, the ram and piston may be replaced with a second valve assembly of the present invention, for operation of the bolt. In that case, the back block can also be eliminated. The valve assembly 32 can be offered as a single, "drop in" or replacement unit 192, as shown in FIG. 12. A replacement unit may also be offered as a single unit comprising a high pressure chamber and a valve assembly in combination.

An "in-line" embodiment (as opposed to a "stacked" or top/bottom arrangement as in the previous embodiments), of a valve assembly according to the present invention is shown in FIGS. 14-18A. The valve assembly 250 includes a valve housing 252 having a first end 256 and a second end 258, housing a valve body 254. The valve housing 252 defines a primary chamber 278 that houses at least a portion of the valve body 254 and a first pressure area 322. The first end 256 of the valve housing 252 further includes an elongated wall 276 defining a main valve port 280. A primary chamber 278 is provided adjacent the main valve port 280, which will accumulate compressed gas. The valve housing 252 further defines a secondary chamber 290 and a second pressure area 324. The secondary chamber 290 is provided adjacent the second end 258 of the valve housing 252.

Figure 15:
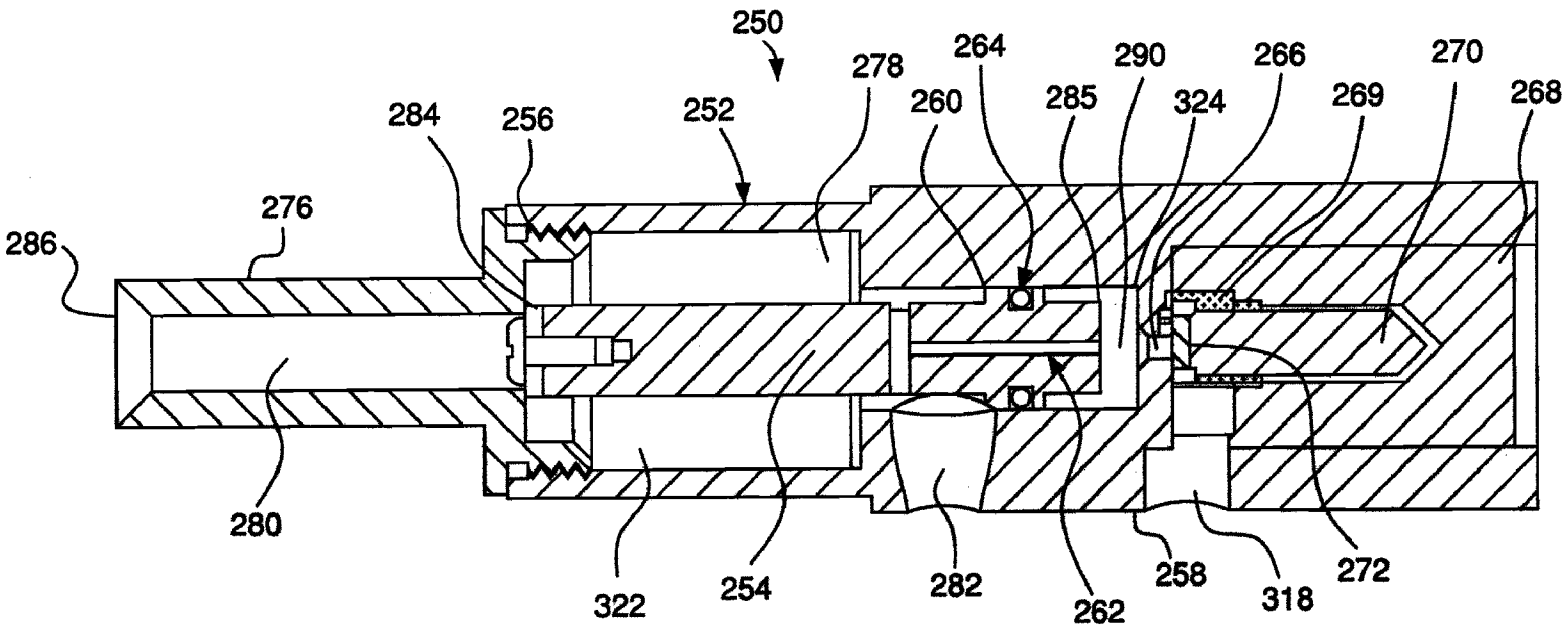
FIG. 15 shows a sectional view the valve assembly of the present invention shown in FIG. 14, taken along line 15-15, with the valve assembly in the closed position.

The valve body 254 has a first end 284 and a second end 285. The valve body 254 is moveable within the valve housing 252 from a first position adjacent the first end 256 of valve housing 252, to a second position adjacent the second end 258 of the valve housing. The valve body 254 is provided with an enlarged portion 260 positioned within channel 262 adjacent the second end 258 of the valve housing 252. In the first position, the valve body 254 may selectively close a flow passage 326, as shown in FIG. 15, provided adjacent the first end 256 of the valve housing 252 providing fluid communication between primary chamber 278 and main valve port 280 when the valve assembly 250 is in the open positioned.

Channel 262 runs along at least a portion of the length of valve body 254. The enlarged portion 260 may be fitted with an O-ring 264 to assist in sealing the channel 262. The valve body 254 has a first end 284 that is adapted to close opening 286 in main valve port 280 when the valve body 254 is in the first or closed position.

An inlet port 282 is provided as an opening in the valve housing 252 in communication with channel 262 forward the enlarged portion 260. The inlet port 282 is adapted to receive compressed gas from a source of compressed gas (not shown). A secondary exhaust port 266 is provided adjacent the second end 258 of the valve housing 252.

A solenoid 268 is provided adjacent the secondary exhaust port 266. The solenoid 268 may be housed within the valve housing 252, as shown in FIGS. 14-18A, or may be a separate assembly. The solenoid 268 has a solenoid plunger 270 biased by a solenoid spring 269, with a sealing portion 272 that closes off the secondary exhaust port 266.

The valve assembly 250 operates as follows. When the solenoid is not activated, sealing portion 272 of solenoid plunger 270 closes secondary exhaust port 266, as shown in FIG. 15. The enlarged portion 260 divides the valve assembly into a primary chamber 278 and a secondary chamber 290. Compressed gas from a compressed gas source enters the inlet port 282, and accumulates in the primary chamber 278 and the secondary chamber 290 as compressed gas from the primary chamber 278 passes through channel 262. As previously described, due to the difference in the effective surface areas of the valve body 254 in the primary chamber 278 and the secondary chamber 290, and the lack of pressure in the main valve port 280, the pressure force of the compressed gas in the secondary chamber 290 biases the valve body 254 to the first end 256 of the valve housing 252. The first end 284 of the valve body 254 rests against opening 286, and closes main valve port 280.

Figure 16:
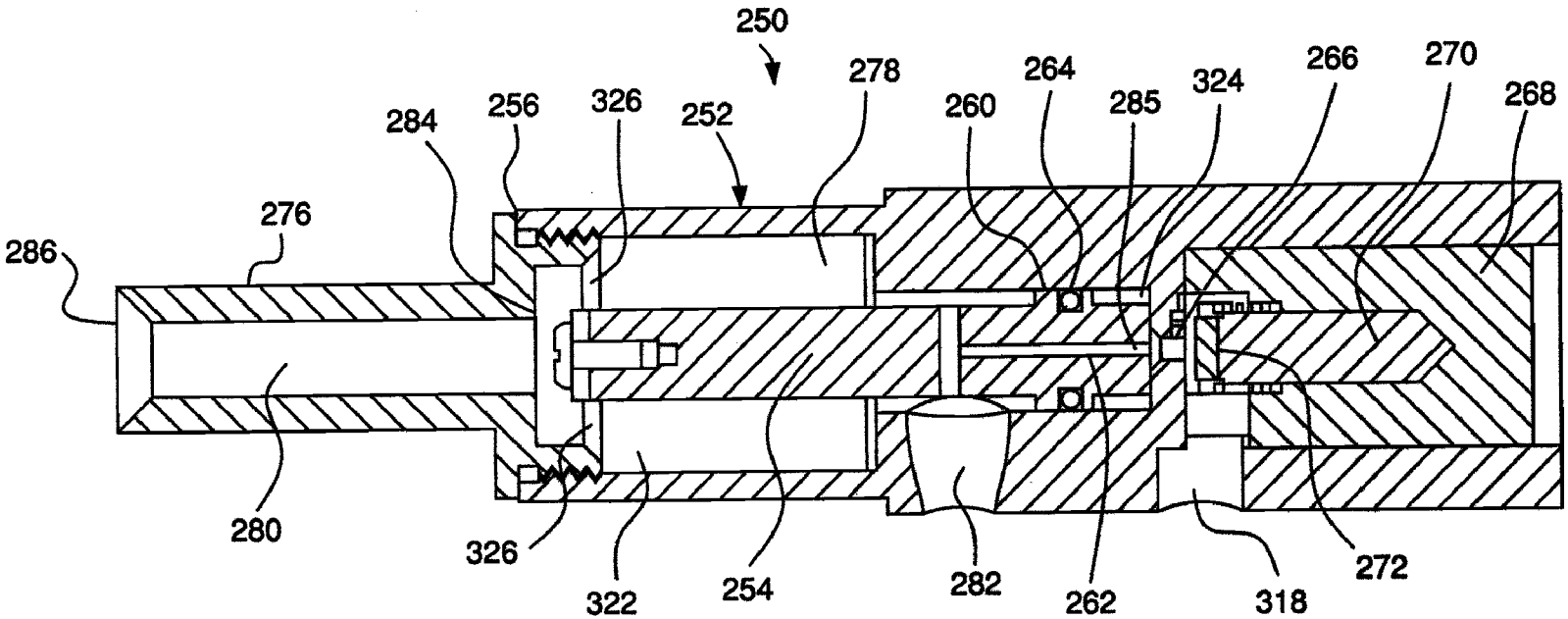
FIG. 16 shows a sectional view the valve assembly of the present invention shown in FIG. 14, with the valve assembly in the open position.

When the solenoid is activated, the solenoid plunger 270 is moved away from secondary exhaust port 266, as shown in FIG. 16, and compressed gas in the secondary chamber 290 is vented, such as to atmosphere through exhaust opening 318. The pressure force imbalance acting on the valve body 254 forces the valve body 254 toward the second end 258 of the valve housing 252, thereby moving first end 284 of the valve body 254 away from opening 286, and opening main valve port 280. The high pressure compressed gas accumulated in the primary chamber 278 can now rush out of the valve housing 252 through the main valve port 280. When the solenoid 268 is inactivated, solenoid plunger 270 returns to close secondary exhaust port 266.

Figure 17:
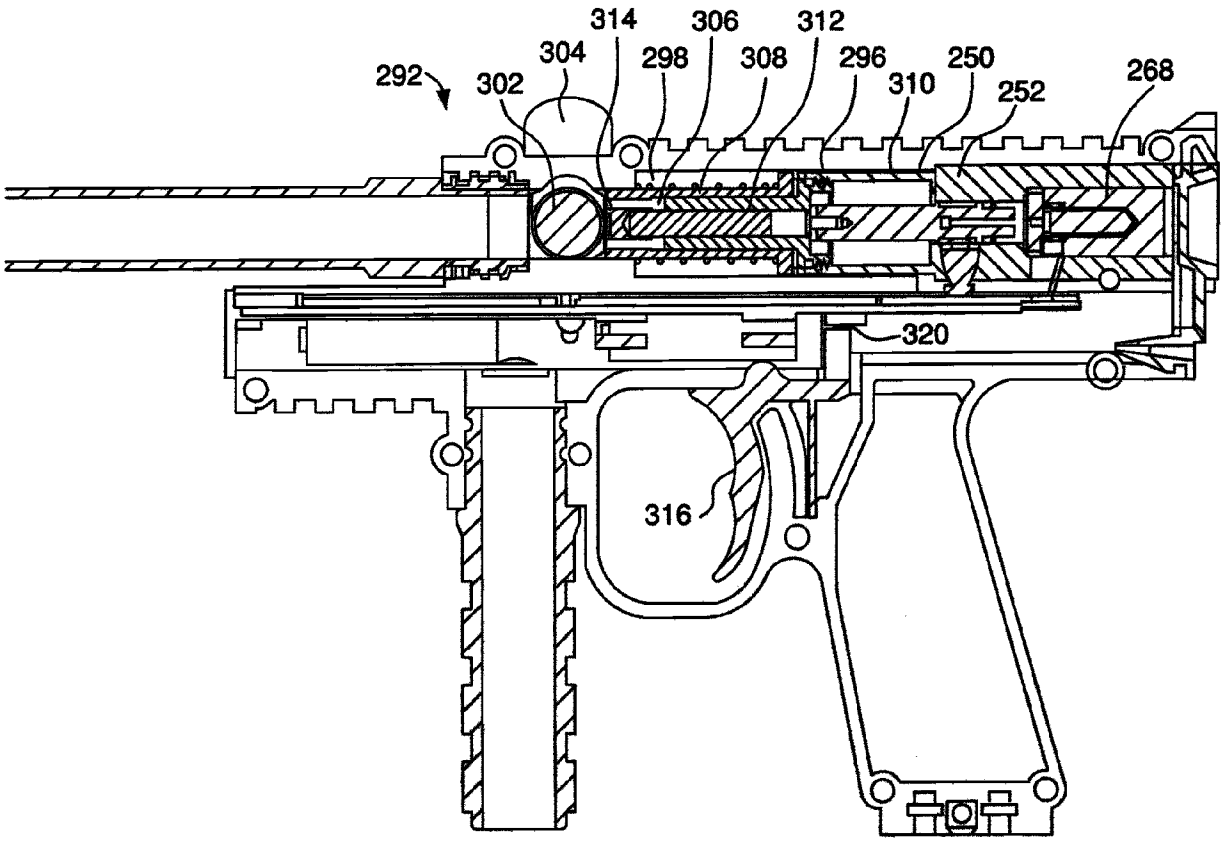
FIG. 17 shows a side sectional view of a compressed gas gun employing the valve assembly of FIG. 16 with the gun in the ready to fire position.
Figure 17A:
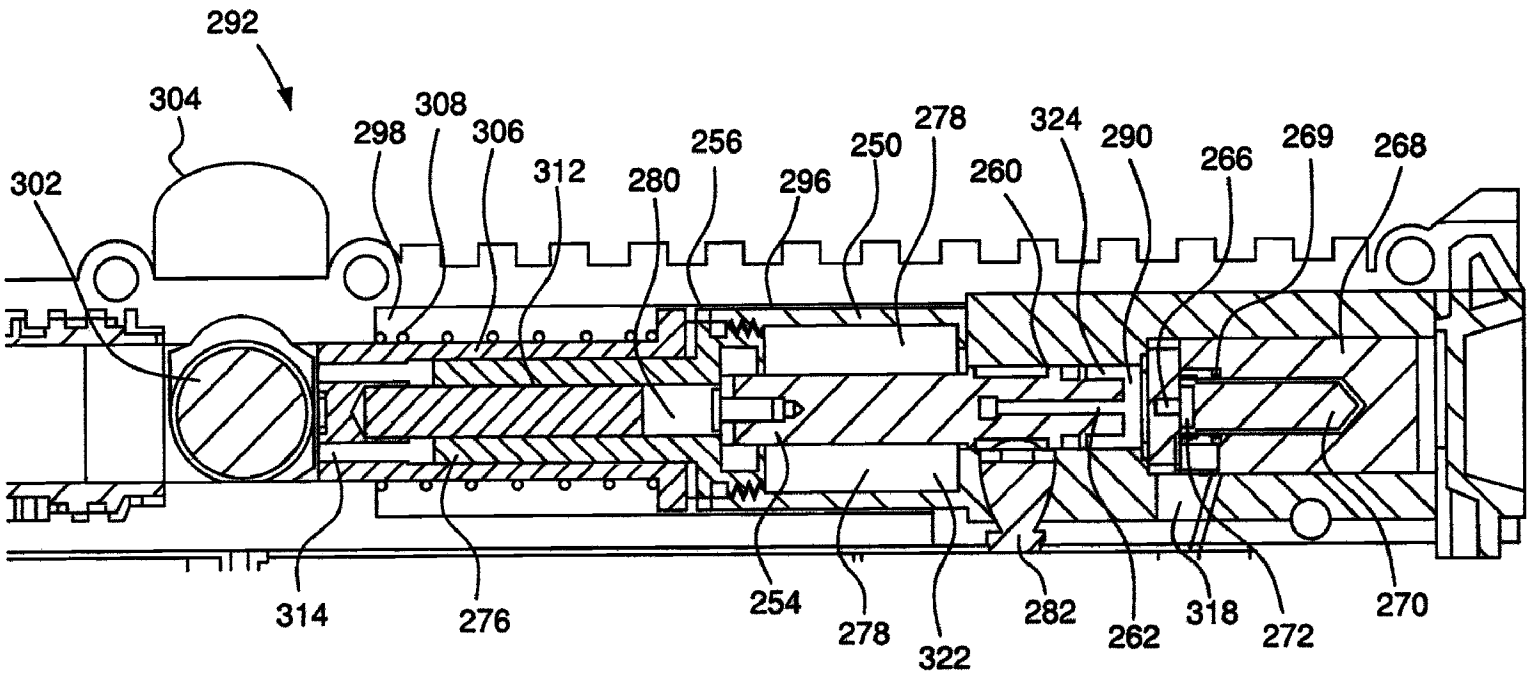
FIG. 17A shows a close up view of the valve assembly shown in FIG. 17.

A compressed gas gun 292 employing this embodiment of the valve assembly 250 of the present invention may operate as follows. Referring to FIG. 17, gun body 294 defines a chamber 296 running along a longitudinal axis of gun body 294. The chamber 296 is in communication with breech 300, for chambering projectiles 302. Projectiles 302 are received into breech 300 via infeed opening 304. The chamber 296 has a bolt section 298 and a valve section 310.

A bolt section 298 of the chamber 296 houses a bolt 306 moveable from a rearward or loading position to a forward or firing position. The bolt 306 is biased to a loading position by bolt spring 308. Thus, the gun 292 is designed to operate from an open bolt action. A bolt piston 312 is provided as a pneumatically moveable piston attached to a portion of the bolt 306, and adapted to extend into main valve port 280. A bolt aperture 314 is provided as a channel running through a portion of the bolt 306. A valve section 310 of the chamber 296 houses the valve assembly 250.

As shown in FIG. 17, in the loading or ready to fire position, the solenoid 268 is not activated, sealing portion 272 of solenoid plunger 270 closes secondary exhaust port 266. When trigger 316 is pulled, an electronic signal is sent to solenoid 268, and the solenoid plunger 270 is moved away from secondary exhaust port 266. The valve assembly 250 operates as described above.

Figure 18:
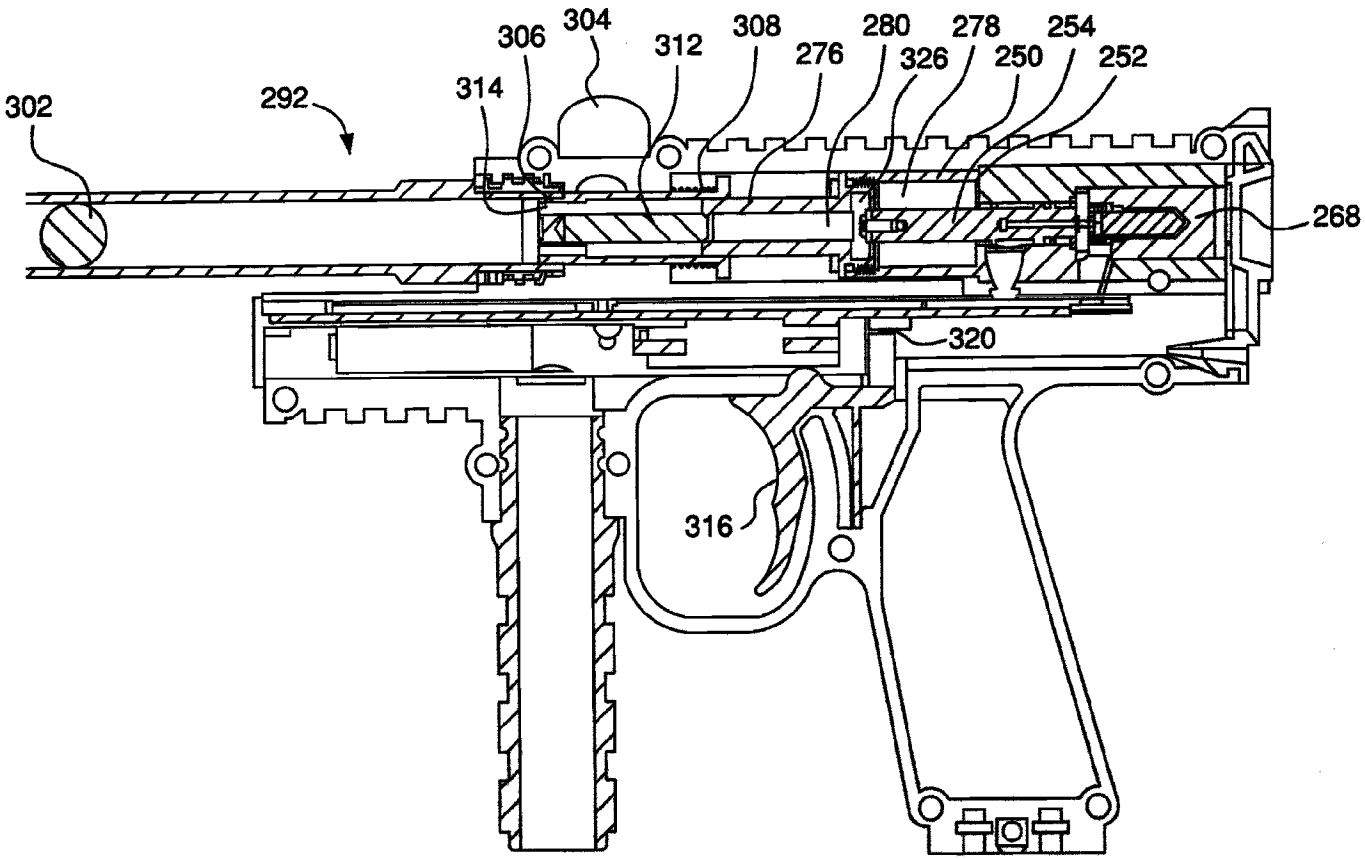
FIG. 18 shows a side sectional view of the compressed gas gun of FIG. 17, in the firing position.
Figure 18A:
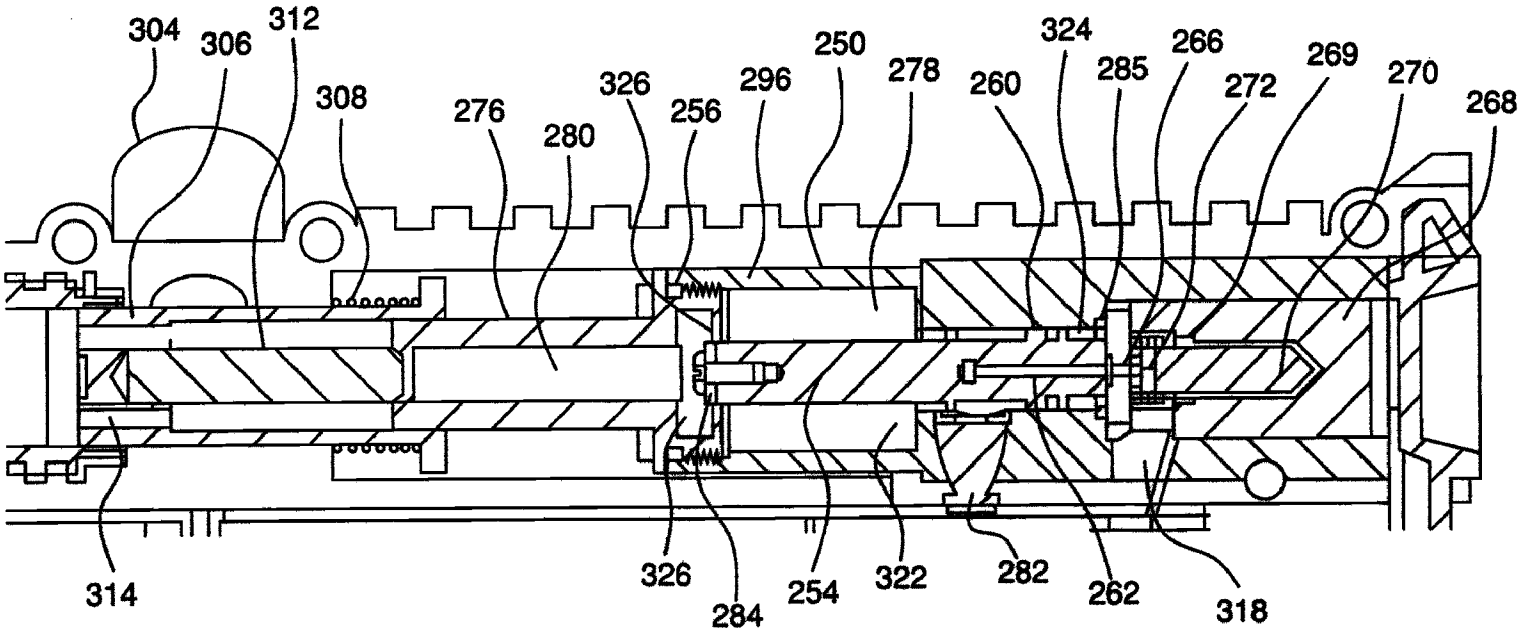
FIG. 18A shows a close up view of the valve assembly shown in FIG. 18.

When the main valve port 280 is open, compressed gas forces the bolt piston 312 forward, thereby moving the bolt 306 to a firing position, as shown in FIG. 18. When bolt 306 reaches its firing position, the bolt piston 312 is removed from the main valve port 280. Compressed gas flows from the main valve port 280 out through the bolt aperture 314, thereby firing the projectile 302 from the gun 292. In this novel arrangement, the valve assembly used for firing a projectile is also used for moving the bolt. In addition, the same compressed gas stored in the valve assembly for firing a projectile is also used for moving the bolt.

Trigger 24 can be provided as a trigger 24 activating an electronic switch 320, as shown in FIG. 4, for example. The electronic control circuitry 96 may be used to control operations of the gun, such as a firing operation. A microprocessor may be used as part of the electronic control circuitry 96 to control gun operation such as a firing operation, as well as to monitor, track and/or display variables of gun operation, including tracking data such as shots fired, power supply, game time, firing parameters, firing mode, etc. A power source such as a battery 40 may be housed in the grip portion of the trigger frame.

Having thus described in detail several embodiments of the Valve Assembly For A Compressed Gas Gun of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

Having thus described in detail several embodiments of the attachment system of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A compressed gas gun, comprising:

a gun body;

a trigger;

an upper chamber housing a bolt, the bolt moveable from a loading position to a firing position, the bolt having an aperture therethrough;

a lower chamber comprising a valve assembly comprising:

a valve housing, a selectively closeable flow path through the valve housing, a valve body disposed in the valve housing moveable from a first position closing the flow path to a second position opening the flow path, the valve body having a channel therethrough, a secondary chamber on an opposite side of the valve body from the flow path, an exhaust port in communication with the secondary chamber; and, a solenoid adjacent the secondary exhaust port, the solenoid adapted to selectively close the secondary exhaust port;

a high pressure chamber adapted to receive compressed gas from a source of compressed gas in communication with the valve housing via the opening; and, wherein actuating the trigger initiates a firing operation by sending an electrical signal to the solenoid.

2. The compressed gas gun of claim 1, wherein the compressed gas gun is of the closed bolt type.

3. The compressed gas gun of claim 1, wherein the gun body further comprises a firing port providing fluid communication between the flow path and the bolt aperture when the bolt is in a firing position.

4. The compressed gas gun of claim 1, wherein the housing has a first end and a second end, wherein the valve body divides the valve housing into a second pressure area adjacent the secondary exhaust port and a first pressure on an opposite side of the valve body, the second pressure area having a greater effective surface area than the first pressure area when the solenoid closes the secondary exhaust port.

5. The compressed gas gun of claim 1, wherein the solenoid comprises a solenoid plunger including a sealing portion, the sealing portion movable from a first position closing the exhaust port, to a second position opening the exhaust port.

6. The compressed gas gun of claim 1, further comprising a high pressure chamber adapted to receive compressed gas from a source of compressed gas.

7. The compressed gas gun of claim 1, wherein the valve body is moveable by the application of pneumatic force.

8. The compressed gas gun of claim 1, further comprising a spring biasing the valve body to close the flow path.

9. The compressed gas gun of claim 1, further comprising an electronic control circuit for controlling a firing operation of the compressed gas gun.

10. The compressed gas gun of claim 1, wherein the bolt is adapted to be moved in at least one direction by the application of pneumatic force.

11. The compressed gas gun of claim 1, wherein the bolt is adapted to be biased in at least one direction by a spring.

12. A compressed gas gun of the closed bolt type, comprising:

a gun body;

a trigger;

an upper chamber housing a bolt, the bolt moveable from a loading position to a firing position, the bolt having an aperture therethrough;

a lower chamber comprising:

a first valve assembly, comprising:

a valve housing, a selectively closeable flow path through the valve housing, a valve body disposed in the valve housing moveable from a first position closing the flow path to a second position opening the flow path, the valve body having a channel therethrough, a secondary chamber on an opposite side of the valve body from the flow path, an exhaust port in communication with the secondary chamber; and, a solenoid adjacent the secondary exhaust port, the solenoid adapted to selectively close the secondary exhaust port;

a high pressure chamber adapted to receive compressed gas from a source of compressed gas in communication with the valve housing via the opening, a bolt piston passage housing a bolt piston, the bolt piston pneumatically moveable from a first position to a second position;

wherein at least a portion of the bolt is adapted to be contacted by the bolt piston and to move the bolt when the bolt piston moves the at least a portion of the bolt;

a second valve assembly for providing compressed gas from the high pressure chamber to the bolt piston passage, comprising:

a valve housing, a selectively closeable flow path through the valve housing in communication with the bolt piston passage, a valve body disposed in the valve housing moveable from a first position closing the flow path to a second position opening the flow path, the valve body having a channel therethrough, a secondary chamber on an opposite side of the valve body from the flow path, an exhaust port in communication with the secondary chamber; and, a solenoid adjacent the secondary exhaust port, the solenoid adapted to selectively close the secondary exhaust port;

wherein actuating the trigger initiates a firing operation by sending at least one electrical signal to at least one of the first solenoid and the second solenoid.

13. The compressed gas gun of claim 12, wherein the gun body further comprises a firing port providing fluid communication between the flow path of the first valve and the bolt aperture when the bolt is in a firing position.

14. The compressed gas gun of claim 12, wherein the bolt is biased to a firing position by a bolt spring.

15. The compressed gas gun of claim 12, wherein the solenoid comprises a solenoid plunger including a sealing portion, the sealing portion movable from a first position closing the exhaust port, to a second position opening the exhaust port.

16. The compressed gas gun of claim 12, further comprising a high pressure chamber adapted to receive compressed gas from a source of compressed gas.

17. The compressed gas gun of claim 12, wherein the valve body is moveable by the application of pneumatic force.

18. The compressed gas gun of claim 12, further comprising a spring biasing the valve body to close the flow path.

19. The compressed gas gun of claim 12, further comprising an electronic control circuit for controlling a firing operation of the compressed gas gun.

20. The compressed gas gun of claim 12, wherein the bolt is adapted to be moved in at least one direction by the application of pneumatic force.

21. The compressed gas gun of claim 12, wherein the bolt is adapted to be biased in at least one direction by a spring.

22. A method of moving a bolt in a closed bolt paintball marker, the method comprising:

providing a bolt piston passage housing a bolt piston, the bolt piston moveable from a first position to a second position upon receiving a supply of compressed gas to the bolt piston passage;

providing a bolt moveable from a loading to a firing position, at least a portion of the bolt adapted to contact the bolt piston;

providing a valve assembly, the valve assembly comprising:

a valve housing in communication with the bolt piston passage, a selectively closeable flow path through the valve housing, a valve body disposed in the valve housing moveable from a first position closing the flow path to a second position opening the flow path, the valve body having a channel therethrough, a secondary chamber on an opposite side of the valve body from the flow path, an exhaust port in communication with the secondary chamber; and, a solenoid adjacent the secondary exhaust port, the solenoid adapted to selectively close the secondary exhaust port; and, providing a high pressure chamber for receiving compressed gas from a compressed gas source in communication with the valve assembly;

selectively supplying compressed gas from the high pressure chamber to the bolt piston passage by actuating a trigger, the trigger initiating a firing operation by sending an electrical signal to the solenoid.

* * * * *